US007635052B2

(12) United States Patent
Ceballos-Godefroy et al.

(10) Patent No.: US 7,635,052 B2
(45) Date of Patent: Dec. 22, 2009

(54) DEMOUNTABLE DISPLAY MODULE WHICH IS STORED IN THE FORM OF A BRIEFCASE AND PRODUCTION METHOD THEREOF

(76) Inventors: Ricardo Ceballos-Godefroy, 2a, Cerada de Adolfo Prieto No. 16, Col. Del Valle 03100 (MX); Herman Federico Neumann-Duran, 2a, Cerada de Adolfo Prieto No. 16, Col. Del Valle 03100 (MX)

( * ) Notice: Subject to any disclaimer, the term of this patent is extended or adjusted under 35 U.S.C. 154(b) by 185 days.

(21) Appl. No.: 11/993,192

(22) PCT Filed: Jun. 20, 2005

(86) PCT No.: PCT/IB2005/002083

§ 371 (c)(1),
(2), (4) Date: Dec. 19, 2007

(87) PCT Pub. No.: WO2006/136874

PCT Pub. Date: Dec. 28, 2006

(65) Prior Publication Data

US 2009/0032349 A1 Feb. 5, 2009

(51) Int. Cl.
*A45C 9/00* (2006.01)

(52) U.S. Cl. ..... 190/103; 190/100; 190/107; 211/149; 29/592

(58) Field of Classification Search ..... 190/103, 190/107, 100; 211/149, 135, 134; 29/592
See application file for complete search history.

(56) References Cited

U.S. PATENT DOCUMENTS 2,707,538 A * 5/1955 Mayer, Sr. et al. ..... 190/16
3,938,772 A * 2/1976 Andrusiak ..... 248/461
4,524,852 A * 6/1985 Hess ..... 190/16
4,852,498 A * 8/1989 Judd ..... 108/43
5,984,092 A * 11/1999 Heard-Willmon ..... 206/233
6,189,594 B1 * 2/2001 Carter ..... 160/135
6,666,424 B2 * 12/2003 Richardson ..... 248/460
7,543,704 B2 * 6/2009 Miller ..... 206/373

FOREIGN PATENT DOCUMENTS

DE 8513468 U1 6/1985
EP 0575275 B1 12/1995
JP 06151178 A4 1/1996

* cited by examiner

*Primary Examiner*—Anthony Stashick
*Assistant Examiner*—Cynthia F Collado
(74) *Attorney, Agent, or Firm*—Lackenbach Siegel, LLP

(57) ABSTRACT

A demountable display module that is stored in the form of a briefcase is described; it comprises a base formed by panels; a cover demountably attached to the base; posts that are demountably to the frames of the side panels of the base; and a board demountably attached to the upper end of the posts. Within the base, there is a first shelf and a second shelf each of them is housed in the inner part of one of the side panels. Likewise, first and second support and securing means are provided to keep the shelves in horizontal position and to secure the shelves in vertical position when they are housed in the side panel to which they attach. The cover of the module is used as a container body to house the rest of the elements of the module and it includes a handle to transport the module in the form of a briefcase; likewise, the method to manufacture the module is described.

23 Claims, 13 Drawing Sheets

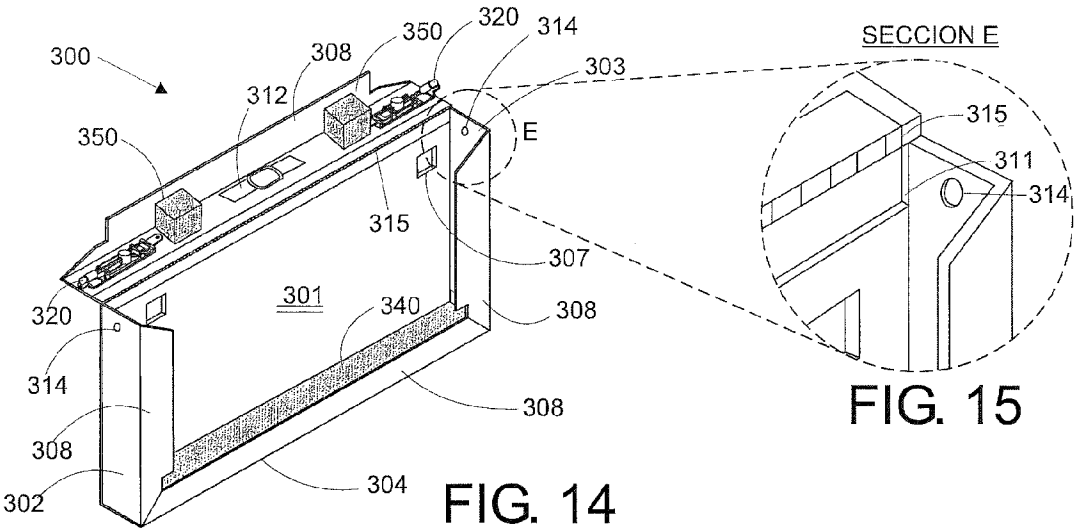
FIG. 15
FIG. 14
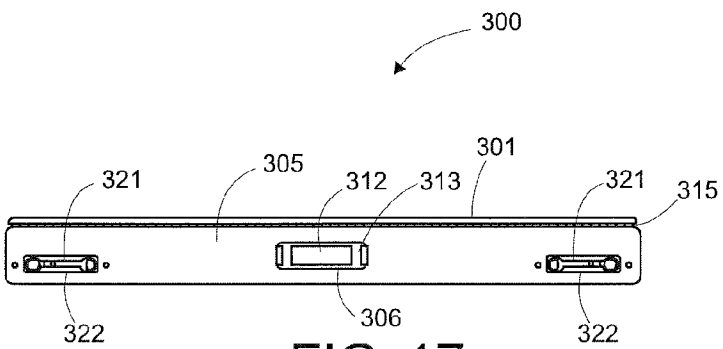
FIG. 17
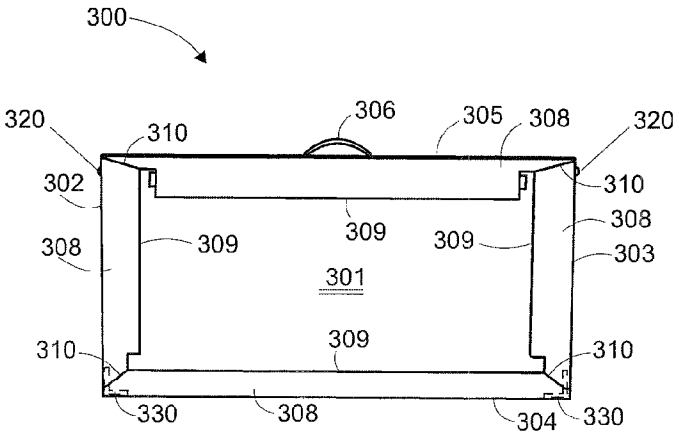
FIG. 16

DEMOUNTABLE DISPLAY MODULE WHICH IS STORED IN THE FORM OF A BRIEFCASE AND PRODUCTION METHOD THEREOF

This application claims priority to PCT patent application PCT/IB2005/002083, filed Jun. 20, 2005 and incorporates this application in its entirety by reference thereto.

FIELD OF THE INVENTION

The present invention relates to techniques employed in the manufacture and design of furniture, showcases and displays that offer products and services and, in particular, the invention relates to a demountable display module which is stored in the form of a briefcase and production method thereof.

BACKGROUND OF THE INVENTION

In many places where public gather for the acquisition and exposure of products and services, such as fairs, conventions, information centers and so on, there is a need to use furniture and counters to approach the public to the suppliers and introduce them to their products. In this regard, there exists an important variety of such furniture, e.g. wooden-made, metallic, furnished with shelves, partitions; in general terms, though, they are bulky, difficult to handle and transport thereof results in hardships since they take up a lot of space.

One art-known solution to such problems has involved the creation of carton foldable furniture and counters. Nevertheless, their structural rigidity is poor and, furthermore, it is impossible for one person to lean thereon. In addition, this type of carton-made furniture lacks of an outstanding aesthetical appearance, which is an important factor to achieve a commercial impact of the product or service being supplied.

There also exists furniture with countless panels, rods and posts that cooperate to each other; however, assembly thereof is time-consuming and the pieces to be assembled are too many.

Despite the above, there are exhibition devices that have been broadly the base and a board above the cover. In this type of counters, the board helps to identify the name of the supplier or the product being offered while the supplier is located behind the counter to attend to the customers approaching the module.

One of such modules is disclosed in Mexican patent No. 212,227, which most significant advantage is that the module elements can be disassembled and stored in the form of a briefcase. In the module of said patent, a hinged shelf is included within the base. Nevertheless, one issue with such module is that the shelf and the post sections supporting the board are movable within the base when they are stored therein. In addition, when the module is assembled, the posts and board are scarcely stable; furthermore, the pins employed to close the cover go outside and, therefore, are prone to failures.

The module of the above-mentioned patent was restructured in Mexican patent No. 225, 710, wherein the most significant changes are the inclusion of 45° cuttings between the post sections and a second shelf that runs on a rail, in addition a support to secure the post sections within the second shelf was included. In spite of such modification, the board continues being unstable since it sways over the cover. Furthermore, the shelves frequently fall off their horizontal position because at their free side ends the shelves are secured only by pressure between the side panels of the base. Also, the cover (body of the briefcase) faces strength issues when the module is stored therein; particularly, the cover is prone to breaking when being handled and hauled; more specifically, it has been observed that when the cover is knocked at its bottom, the impact is passed on to the side faces, reaching the lid and breaking it. It is desirable to improve the strength of the cover, taking into account that it is the most critical piece when the module is stored in the form of a briefcase.

Another issue is the generation of scratches on top of the base panels every time the bases is taken out of or put into the cover. Likewise, it has been observed that when the base is inside the cover, the former moves upwards and downwards, resulting in deterioration of the base.

On the other hand, the above Mexican patents do not address the manner in which such module may be manufactured. However, give the acceptance of such product in the market; it is desirable to have a sequential and logical manufacturing process that maximizes the usage of materials from which the essential elements of the display module are made.

SUMMARY OF THE INVENTION

Pursuant to the above, the purpose herein has been to overcome the drawbacks of prior art display modules that are stored in the form of a briefcase through the development of a novel structural relationship among the essential elements thereof, as well as through the addition of new elements that help work out such prior art issues.

The display module that is stored in the form of a briefcase of the present invention comprises: a base formed by panels hingedly connected one next to the other such that said base has a "collapsed" and a "stand up" position, wherein said panels define at the base: a first side panel, a first front panel perpendicular to the first side panel, a second front panel adjacent the first front panel and a second side panel perpendicular to the second front panel and opposed to the first side panel; each of said panels being formed by a rectangular frame and a sheet that covers and is coupled to the frame; on the other hand, when the base is in the "collapsed" position, each side panel is housed inside the frame of the front panel to which it is coupled and both front panels face against each other.

As another essential element of the module of the present invention, there is provided a cover demountably coupled on top of said base when the latter is in its "stand up" position; said cover has the shape of a rectangular housing with a upper face, two side faces, a front face, a lid with a handle coupled to the upper face and opposed to the front face, lower tabs extending from the front face, the side faces and the lid towards the interior of the cover in parallel with the upper face, a pair of cavities on top of the upper face and means for opening and closing the lid.

Furthermore, other module elements are a pair of posts, each of them being detachably mounted by its lower end to the frame of one of the side panels and crossing said cover through one cavity thereof the cover is mounted on top of said base; the posts being formed by a lower section and an upper section that are coupled one to the other. In this regard, it is important to point out that the coupling of the posts to the frame of each side panel substantially improves the stability of said posts; i.e., the frames of the side panels and the post form a type of framework when coupled together.

The present invention further comprises as another critical element a board demountable joined to the upper end of each of the posts.

The demountable display module of the present invention also comprises a first shelf located between both side panels and elevated with respect to the lower edge of said base in its "stand up" position; said first shelf is slidably joined by one of its side ends to the first side panel and is formed by a first rectangular shelf frame and a first shelf sheet that covers and is attached thereto; said first shelf is housed inside the frame of the first side panel when the base is in its "collapsed" position. Regarding the above, the union of the first shelf to the base facilitates the storage of the first shelf; additionally, pieces used are less complicated than those of the prior art are used.

Inside the base, the module also comprises a second shelf located between both side panels and separated underneath said first shelf; said second shelf is hingedly attached by one of its side ends to the second side panel and is formed by a second rectangular shelf frame and a second shelf sheet that covers and is attached thereto, said second shelf is housed inside the frame of the second side panel when the base is in its "collapsed" position.

The present invention also provide first means for supporting the first shelf in a horizontal position when the base is in its "stand up" position, the first supporting means also being also useful for securing the second shelf in a vertical position when the same is housed inside the frame of the second side panel; there are also provide second means for supporting the second shelf in a horizontal position when the base is in the "standing" position, the second means also being useful for securing the first shelf in a vertical position when the same is housed inside the frame of the first side panel. These first and second supporting and securing means prevent the shelves from losing their horizontal position when they are located between the side panels, and they also secure the shelves when the base is collapsed; thus, the shelves suffer no damage during haulage of the module.

In order to demount and store the module elements in the form of a briefcase, the board is demount off each one of the posts, which in turn are also demount from said cover and the latter ultimately from the base, in which both the first shelf and the second shelf are housed inside the frame of the side panel to which they are attached to; wherein the lower and upper sections of each post uncouple to become housed inside the second shelf frame; thus, the board is placed over the already housed first shelf and the side panels with their respective shelf are housed inside the frame of the front panel to which they are joined; afterwards, the front panels are faced against each other, thereby resulting in the "collapsed" position of said base that is being introduced through the lid of said cover that functions as a container body to store and haul all the module elements in the form of a briefcase.

In one aspect of the present invention, a process for the manufacture of the module is provided, which comprises the following steps:

a) extruding a first tubular profile;

b) cutting said first tubular profile into a first group of six sections, each one of them with a predetermined length;

c) building from the first group of six sections a frame for each of the two side panels of the base, a frame for each of the two front panels of the base, a first shelf frame and a second shelf frame;

d) attach a sheet to each one of the frames formed in the previous step, thereby achieving a first side panel, a second side panel, a first front panel, a second front panel, a first shelf and a second shelf;

e) mounting the first shelf by one of its side ends between the lateral sides of the frame of the first side panel, such that the first shelf becomes slidably attached;

f) mounting the second shelf by one of its side ends to the lower side of the frame of the second side panel, such that the second shelf becomes hingedly attached;

g) fixing first supporting and securing means over the internal surface of each of lateral sides of the frame of the second side panel;

h) fixing second supporting and securing means over the internal surface of the lower side of the frame of the second side panel;

i) assembling the first side panel with the first front panel; the first front panel with the second front panel; and the second front panel with the second side panel, such that the panels hingedly attach one next the other, thereby obtaining the base of the module;

j) thermal-bending a first plate to obtain the main body of the cover in one single piece, said main body including the upper face, the side faces, the front face and the tabs that extend from the side faces and the front face of the cover;

k) thermal bending a second plate to obtain the lid and the lower tab in one single piece, extending therefrom;

l) assembling the lid obtained in the previous step with the main body, thereby obtaining the cover with its lid;

m) extruding a second tubular profile and a third tubular profile, wherein the third tubular profile has reduced diameter than that of the second tubular profile;

n) cutting both the second tubular and the third tubular profiles, thereby obtaining therefrom: a second group of six sections, each one having a predetermined length; and a third group of six sections, each one having a predetermined length;

o) inserting and pasting each of the six sections of the third group from the third tubular profile inside one end of one of the six sections obtained from the second tubular profile, such that each section of the third group projects from the end where each section is inserted into, thereby obtaining by the end of the step the upper and lower sections of each of the two posts and each of the two coupling bases of the board;

p) pasting the coupling bases obtained in the above step to a sheet, thereby obtaining the board; and q) packing the respective base, the post sections and the board obtained in steps (l), (o) and (p) inside the cover obtained in step (i), so that by the end of this packing step the demountable display module is obtained in the form of a briefcase.

The main advantage of this process is that the materials used are maximized throughout its steps, the process only requiring profiles, sheets and hinges; i.e., material wastage is avoided.

From the above, it can be mentioned that an object of the present invention is to provide a demountable display module that can be stored in the form of a briefcase, wherein the board and the posts hold perfectly stable when the entire module is mounted.

Another object of the present invention is the provision of a demountable display module that can be stored in the form of a briefcase, wherein the shelves thereof are adequately supported in a horizontal position when the module is mounted, and wherein the shelves must remain in a vertical position when the module is stored in the form of a briefcase.

A further object of the present invention is to provide a demountable display module that can be stored in the form of a briefcase, wherein the cover must withstand shocks and accidents when the entire module is stored.

One further object of the present invention is to provide a process for the manufacture of a demountable display module that can be stored in the form of a briefcase, wherein throughout the procedural steps the materials used are maximized.

BRIEF DESCRIPTION OF THE DRAWINGS

Novel aspects featured by the present invention shall be set forth in connection with the appended claims. Nevertheless, the invention itself shall be better understood regarding its structure and manufacturing process thereof, as well as other objects and advantages of the same, with the following detailed description of a preferred embodiment thereof, when read in conjunction with the appended figures, in which:

FIG. 14 is a perspective view of the cover with its lid open, the cover being part of the demountable display module shown in FIG. 1.

FIG. 15 is an expanded view around the area of "D" circle of FIG. 14.

FIG. 16 is a bottom plan view of the cover shown in FIG. 14, its lid being closed.

FIG. 17 is a rear view of the cover shown in FIG. 16.

DETAILED DESCRIPTION OF THE INVENTION

Figure 1:
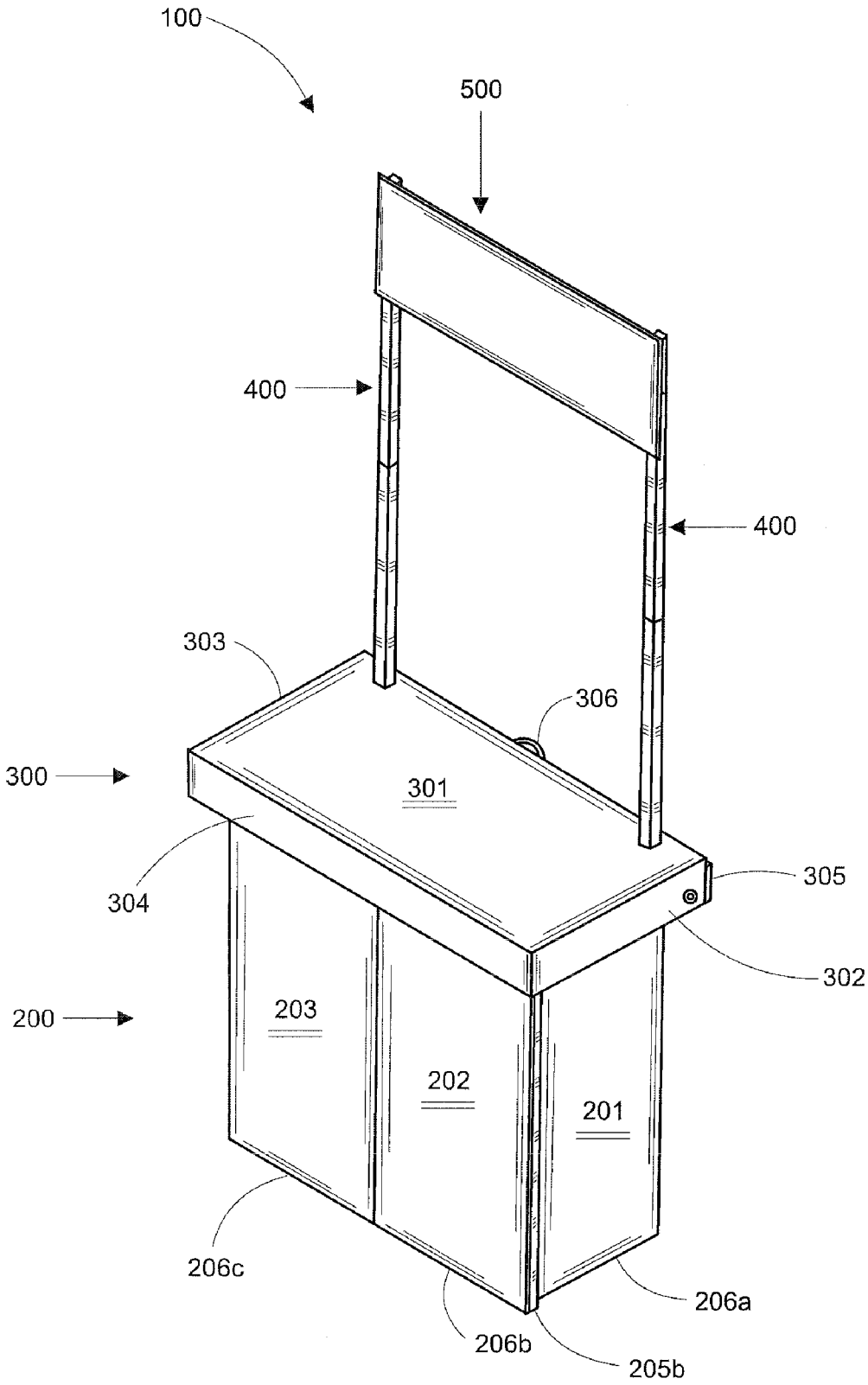
FIG. 1 is a front perspective view of the demountable display module that can be stored in the form of a briefcase, and built in accordance with a preferred embodiment of the present invention.
Figure 2:
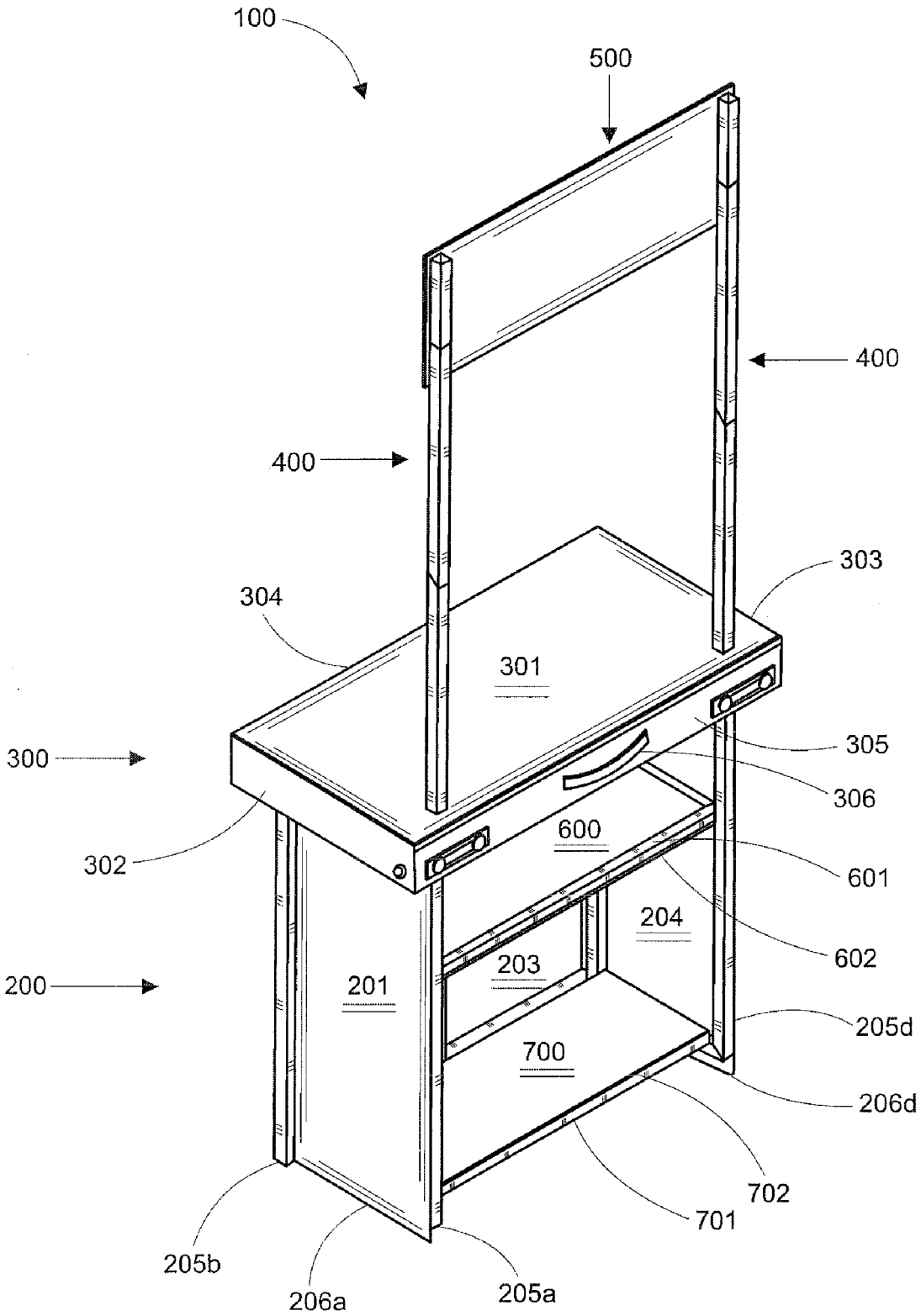
FIG. 2 is a rear perspective view of the demountable display module shown in FIG. 1.
Figure 3:
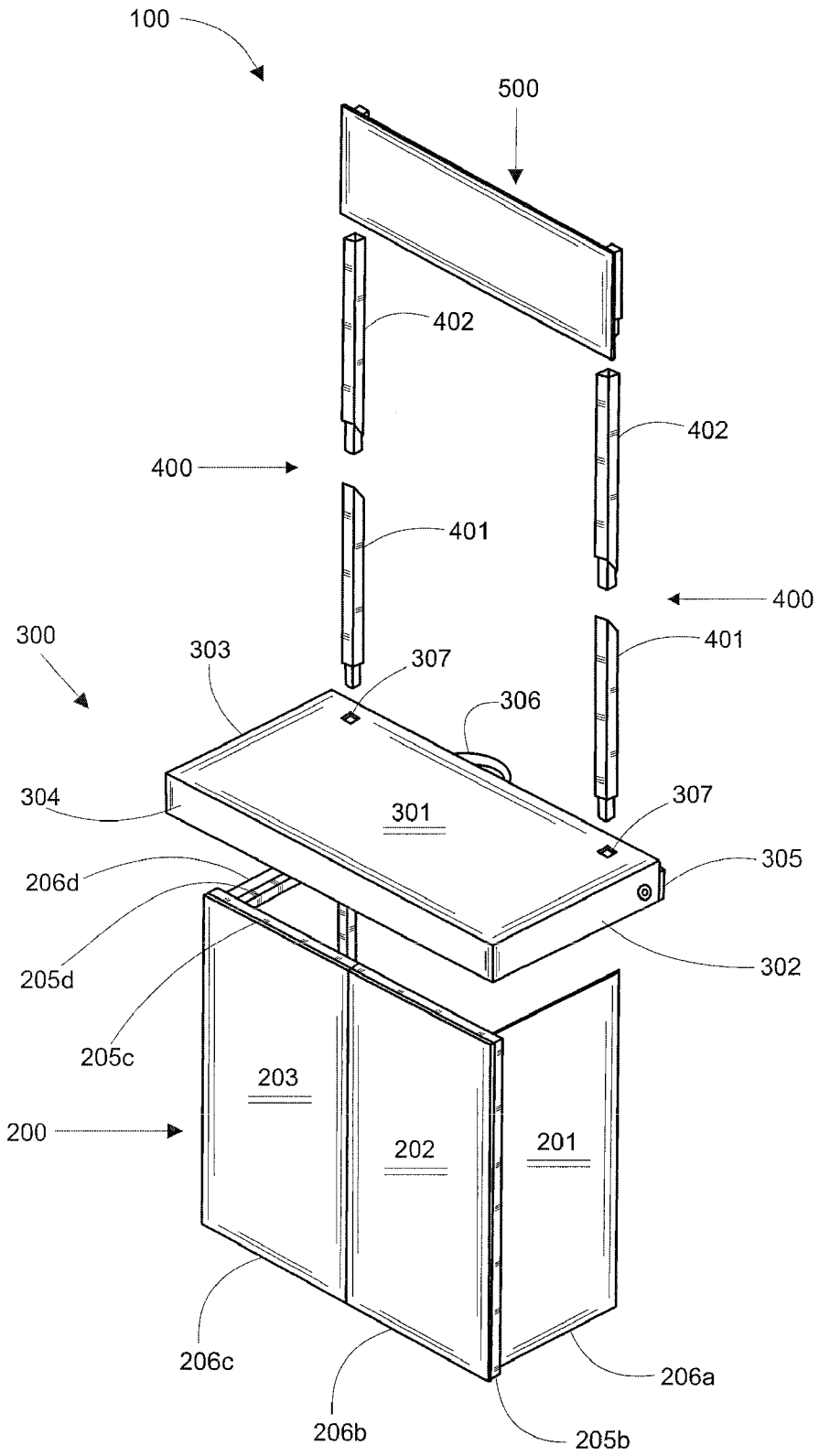
FIG. 3 is a front perspective and exploded view of the demountable display module shown in FIG. 1.

With reference to the accompanying drawings and, more specifically, to FIGS. 1-3 thereof, a demountable display module 100 is shown, said module is stored in the shape of a briefcase. The demountable module 100 comprises a base 20 formed by panels hingedly attached one next to the other, such that said panels define in the base 200: a first side panel 201; a first front panel 202 perpendicular to the first side panel 201; a second front panel 203 adjacent the first front panel 202; and a second side panel 204 perpendicular to the second front panel 202 and opposed to the first side panel 201. Each of said panels 201, 202, 203 and 204 is respectively comprised of a rectangular frame 205*a*, 205*b*, 205*c* and 205*d*, as well as a sheet 206*a*, 206*b*, 206*c*, 206*d* that covers and is attached to the corresponding frame. The construction of the base by means of hinged panels allows for a "standing" position, as seen in FIGS. 1-3, and a "collapsed" position that will be explained later.

The demountable display module 100 also comprises a cover 300 demountably coupled over the upper edge of the base 200. In FIGS. 1-3, it is observed that the cover 300 is shaped like a rectangular housing with an upper face 301, side faces 302 and 303, a front face 304 and a lid 305 hingedly attached to the upper face 301 and opposed to the front face 304. The lid 305 includes a handle 306 to grasp the entire display module 100 when it is demounted and stored in the form of a briefcase. Additionally, the upper face 301 includes a pair of cavities 307, which can be distinguished more clearly in FIG. 3.

In FIGS. 1-3, it is seen that the demountable display module 100 further comprises a pair of posts 400, each of them demountably coupled by its lower end to the frame 205*a* or 205*d* of one of the side panels 201 and 204. In this coupling, each of the posts 400 crosses the cover 300 through one of the cavities 307 when the cover 300 is mounted on the base 200. Likewise, in FIG. 3, it is seen that each of the posts 400 is formed by a lower section 401 and an upper section 402 that are coupled to each other.

From FIGS. 1-3, it is also seen that the display module 100 also has a board 500 that is demountably joined to the upper end of each of said posts. 400. On the board 500 graphic media may be placed, such as signs and legends to identify the services and products of the supplier that is using the demountable display module 100.

By referring to FIG. 2, it can be seen that within the base 200 there exists a first shelf 600 located between both side panels 201 and 204 and raised in respect of the lower edge of the base 200, approximately half way thereof. The first shelf 600 is slidably attached by one of its side ends to the first side panel 201 and is formed by a first rectangular frame shelf 601 and a first shelf sheet 602 that cover and is attached to the frame 601. When the base 200 folds and brought to its "collapsed" position, the first shelf 600 is housed inside the frame 205*a* of the first side panel 201; the latter will be further described later. In the embodiment described, the first shelf 600 is placed at the base 200 with its first shelf frame 601 facing upwards, with the result that the first shelf frame 601 works as a barrier to prevent the articles placed on top of the first shelf 600 from falling off to the ground.

Similarly, the demountable display module 100 comprises a second shelf 700 located between both side panels 201 and 204 and spaced downwards of said first shelf 600 approximately at the lower part of said base 200. The second shelf 700 is hingedly attached by one of its side ends to the second side panel 204 and is formed by a second rectangular shelf frame 701 and a second shelf sheet 702 attached over said frame 701. When the base 200 is brought to its "collapsed" position, the second shelf 700 is housed inside the frame 205*d* of the second side panel 204, which will be explained hereinafter. In the embodiment described, the second shelf is placed at the base 200 with its second shelf frame 701 faced downwards; such orientation will allow the lower section 401 and the upper section of the posts 400 illustrated in FIG. 3 to be housed within the second shelf frame 701 when it is desired that the entire display module 100 be demounted and stored.

Figure 4:
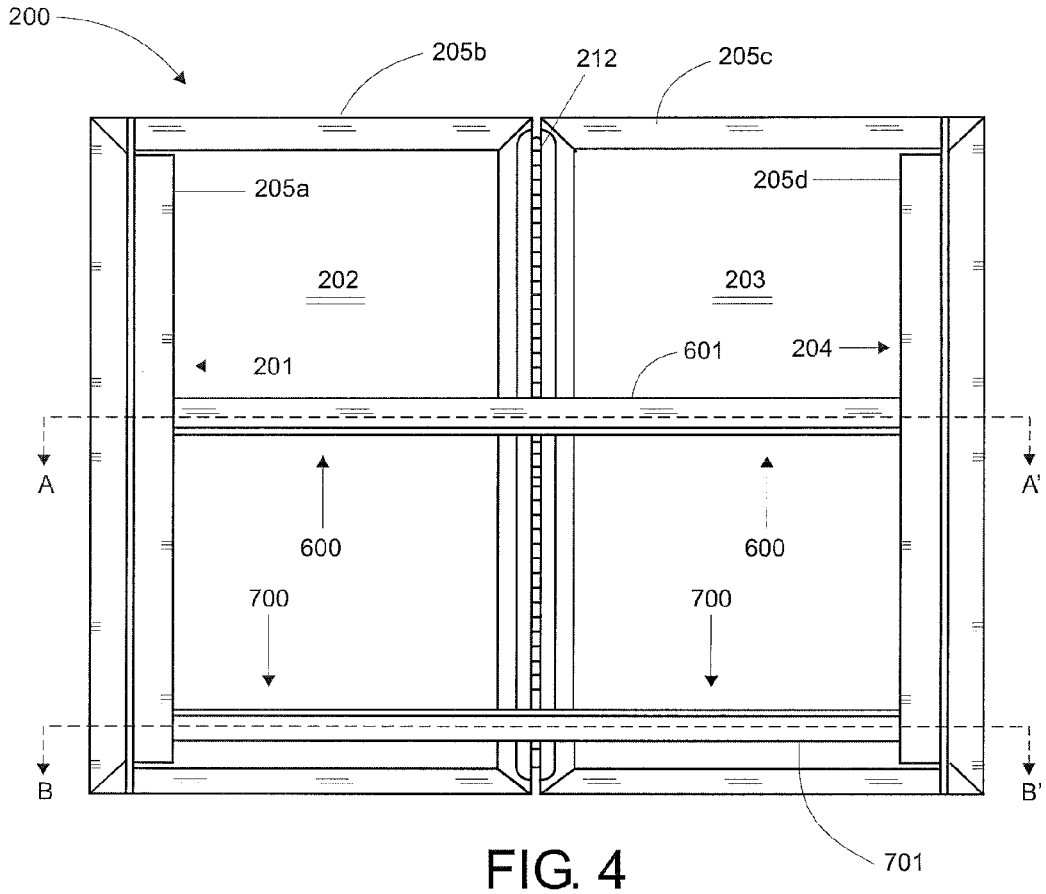
FIG. 4 is a rear view of the base that is part of the demountable display module of FIG. 1.
Figure 5:
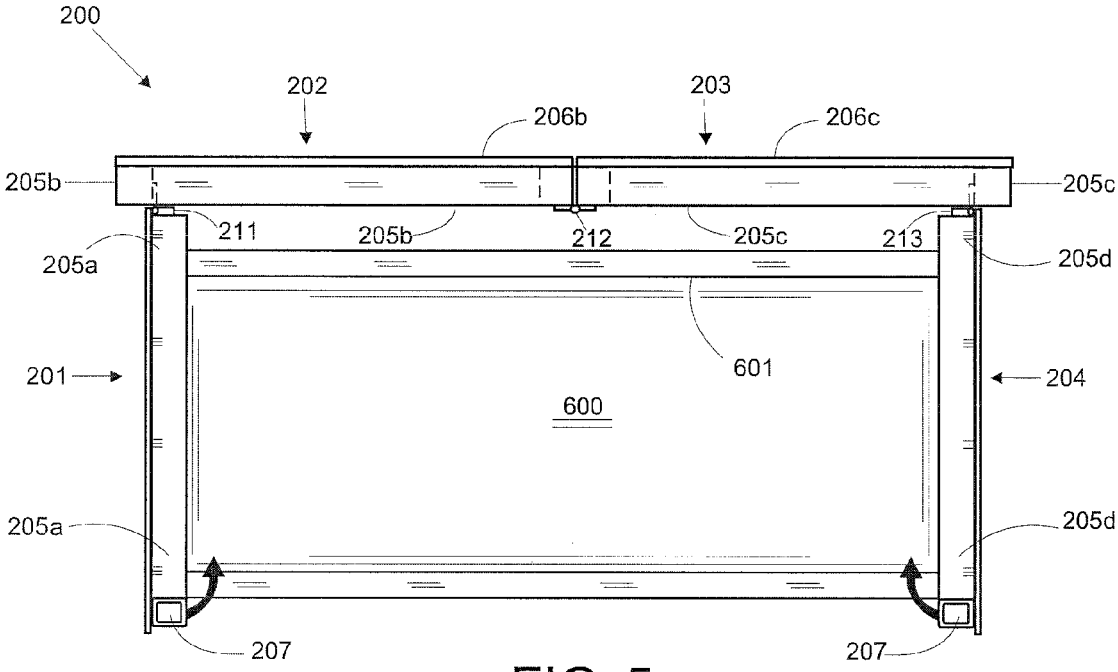
FIG. 5 is a top plan view of the base shown in FIG. 4.

Reference is now made to FIGS. 4 and 5 that respectively show a rear view and a top plan view of the base 200 in its "standing" position. From these figures, it can be mentioned that the first side panel 201 is hingedly attached to the first front panel 202 by means of a first hinge 211 that is fixed between the adjacent lateral sides of the frame 205*a* and the frame 205*b* of both panels 201 and 202, such that the first side panel 201 can outwardly rotate and inwards of the base 200 over said first hinge 211 to become housed within the frame 205*b* of the first front panel 202. In FIG. 5, part of the first hinge 211 and the lower edge of the side of the frame 205*b* from the first front panel 202—where the first hinge 211 is attached—are represented by a dashed line, since they are hidden. It is important to point out that the first hinge 211 runs downwardly over said adjacent lateral sides and that the frame 205*a* of the first side panel 201 has a smaller size than that of the frame 205*b* of the first front panel 202, as seen in FIG. 4; this size differential allows for the first side panel 201 to be housed inside the first front panel 202.

Furthermore, the first front panel 202 is hingedly attached to the second front panel 203 by means of a second hinge 212 that is fixed over the respective adjacent lateral sides of the frame 205*b* and of the frame 205*c* of both front panels 202 and 203. The second hinge 212 runs downwards over said sides and is opposed to the sheet 206*b* and to the sheet 206*c* of each of the front panels 202 and 203 respectively, such that the sheets 206*b* and 206*c* make up a continuous surface towards the front of the demountable module 100, as shown in particular in FIG. 1. Having a continuous surface prevents the printed or graphic media placed on the front panels 202 and 203 from warping or becoming obstructed, one feature desired by suppliers that offer their products in the demountable module 100. In FIG. 5, the lower edge of the adjacent lateral sides of the frames 205*b* and 205*c* are represented by a dashed line in order to appreciate in further detail the arrangement of the second hinge 212. As another important feature, the frames 205*b* and 205*c* of both front panels 202 and 203 have the same size (refer to FIG. 4).

From FIGS. 4 and 5, it can further be mentioned that the second side panel 204 is hingedly attached to the second front panel 203 by means of a third hinge 213 that is fixed between the respective adjacent lateral sides of the frames 205*d* and 205*c* of the second side panel 204 and of the second front panel 203, such that the second side panel 204 may rotate inwards of the base 200 over said third hinge 213 in order to be housed within the frame 205*c* of the second front panel 203. In FIG. 5, part of the third hinge 213 and the lower edge of side of the frame 205*c* from the second front panel 203—where the third hinge 213 is secured—is represented by a dashed line. It is important to mention that the third hinge 213 runs downwards over said adjacent lateral sides and that the frame 205*d* of the second side panel 204 has a smaller size than that of the frame 205*c* of the second front panel 203; said difference allows the second side panel 204 to be housed within the second front panel 203.

In FIG. 4, the first shelf 600 can be seen with its first shelf frame 601 facing upwards, which as mentioned above allows the creation of a barrier for the products placed on top of said first shelf 600. This same FIG. 4 also shows the second shelf with its frame 701 facing downwards.

Another important feature that can be appreciated in FIG. 5 is that both the frame 205*a* of the first side panel 201 and the frame 205*d* of the second side panel 204 include an aperture 207 facing upwards, said aperture 207 has the purpose of housing the lower end of each of the posts 400 shown in FIG. 1. In particular, in FIG. 5, it can be seen that the frame 205*a* and the frame 205*d* of said first and second side panels 201 and 204 preferably include said aperture 207 at its upper and rear corners. This structural relationship for the coupling of the frames 205*a* and 205*d* with each of the posts 400 substantially enhances the stability of the board 500 (see FIG. 1) versus the board stability of the Mexican patents 225,710 and 212,227.

Further describing the structure of the frames 205*a* and 205*d*, which are part of the side panels 201 and 204 respectively, it can be mentioned that they are identically built one to each other. To delve into this aspect, reference is made to FIG. 6, which shows the frame 205*a* from the first side panel. The frame 205*a* is shown unfolded and extended and built be means of a first section 221 of a tubular square profile in cross section, which includes a first group of three triangular cuttings 222 separated of each other. Additionally, it is observed that each cutting 222 encompasses three of the profile's surfaces. On top of each cutting 222, the first section 221 is folded to shape the two lower corners of the frame, as well as the upper and frontal corners, while the upper and rear corners are formed by the perpendicular union of the ends of said first section 221, such that one of said ends of the first section 221 defined said aperture 207.

Figure 6:
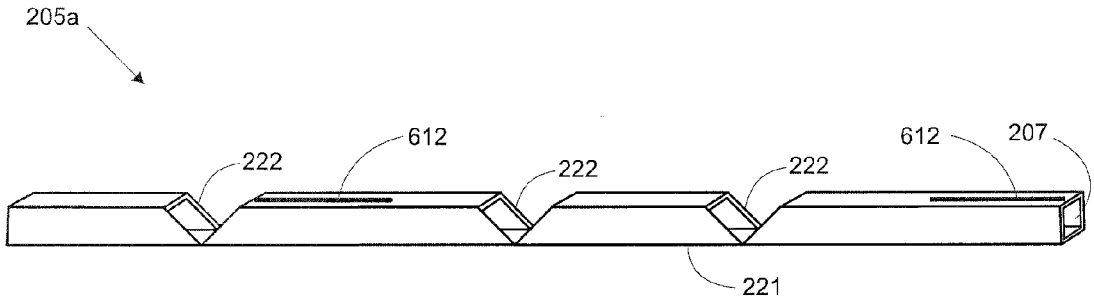
FIG. 6 is an upper perspective view of the frame of one of the side panels of the base illustrated in FIG. 4, the frame being shown unfolded and extended.

Furthermore, in FIG. 6, it is seen that the frame 205*a* of the first side panel has a slot 612 included at the inner surface of each lateral side; this slot 612 has an important function for the first supporting and securing means described hereinbelow, and the slot 612 is not included in the frame of the second side panel.

Figure 7:
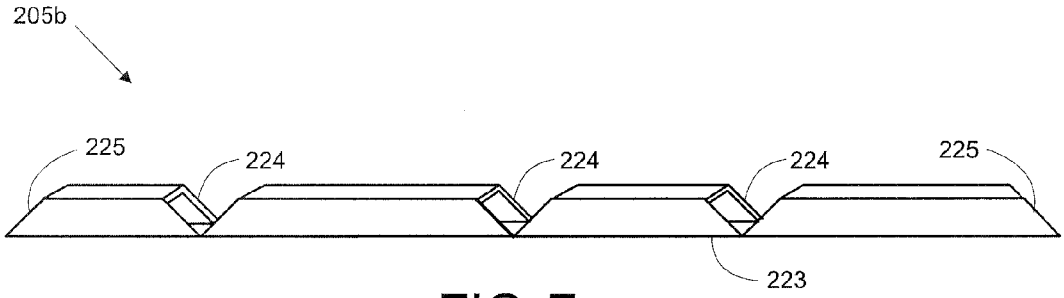
FIG. 7 is an upper perspective view of the frame of one of the front panels of the base illustrated in FIG. 4, the frame being shown unfolded and extended.

Regarding the frame 205*b* of the first front panel 202, the frame 205*c* of the second front panel 203, the first shelf frame 601 and the second shelf frame 701 (see FIGS. 1 through 3), it can be mentioned that these have an identical construction. In order to describe this construction particular reference is made to FIG. 7, which shows the frame 205*b* of the first front panel that is built by means of a second section 223 of a square tubular profile in cross section, which is provided with a second group of three triangular cuttings 224 separated from each other. Each cutting 224 encompasses three of the surfaces of the profile and the second section 223 is bent over each cutting in order to form three of the corners of the frame 205*b*. Likewise, the second section 223 includes a first diagonal cut 225 at 45° in each of its ends, which for the remaining corner of the frame 205*b* when joined together. It is important to point out that the first shelf frame and the second shelf frame (FIG. 2) have the same construction as that described for the frame 205*b* of FIG. 7.

Now it is convenient to make reference to FIGS. 8 through 13, so as to describe the structural relationship between the base 200 and the first shelf 600 and the second shelf 700, as well as to describe other important elements of the present invention.

As previously established, the first shelf must slidably attach, by one of its side ends, to the first side panel through sliding means. In the preferred embodiment being described, the sliding means employed include: a pair of U-shaped sliding bases 610 in cross section, each one of them being inside a lateral side of the frame 205*a* of the first side panel 201; a pair of shafts 611, each one being attached to by one of its ends to one of said sliding bases 610 and by the other end each shaft 611 is attached over the external surface of the corners of a side end of the first shelf frame 601. The latter can be seen in particular in FIG. 8, which is a cut-away alongside the line A-A' of FIG. 4, and is further noticeable in FIG. 9, which is an expanded view around the area in circle "C" of FIG. 8.

Figure 8:
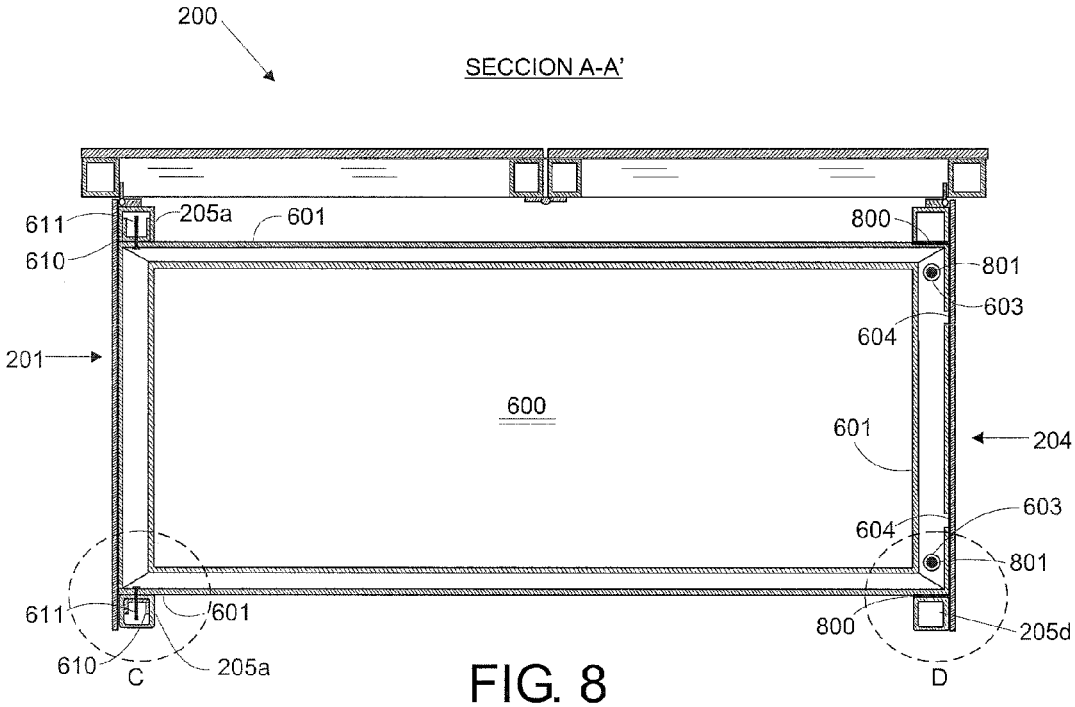
FIG. 8 is a longitudinal section taken alongside line A-A' of the base shown in FIG. 4.
Figure 9:
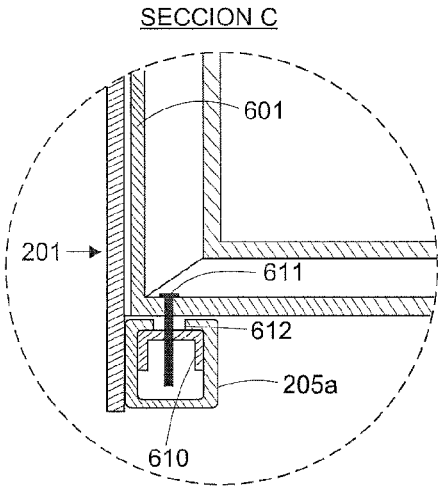
FIG. 9 is an expanded view around the area of circle "C" of FIG. 8.

From FIG. 9, it can be mentioned that each sliding base 610 with its shaft 611 runs downwardly alongside the slot 612 included in the internal surface of each lateral side of the frame 205*a* of the first side panel 201. Therefore, at the lowest part of each slot, said first shelf 600 rotates over the shaft 611 to be placed horizontally between the side panels 201 and 204 of the base when in the "standing" position, such as the first shelf represented in FIG. 8.

Now, to house the first shelf 600 within the frame of the first side panel 201, the first shelf 600 rises over each slot 612 and then rotates over the shafts 611 to be housed in a vertical position inside the frame 205*a* of the first side panel 201. In this regard, the first shelf 600 already housed in the frame 205*a* of the first side panel 201 can be observed in FIG. 12. From this figure, it is important to point out that the sliding means also include an abutment 613 attached to the internal surface of the upper side of the frame 205*a* of the first side panel 201 to restrict the upward movement of the first shelf 600 over the slots 612, which along with sliding bases 610 and the shafts 611 are represented by dashed lines in FIG. 12 since they are hidden.

Figure 11:
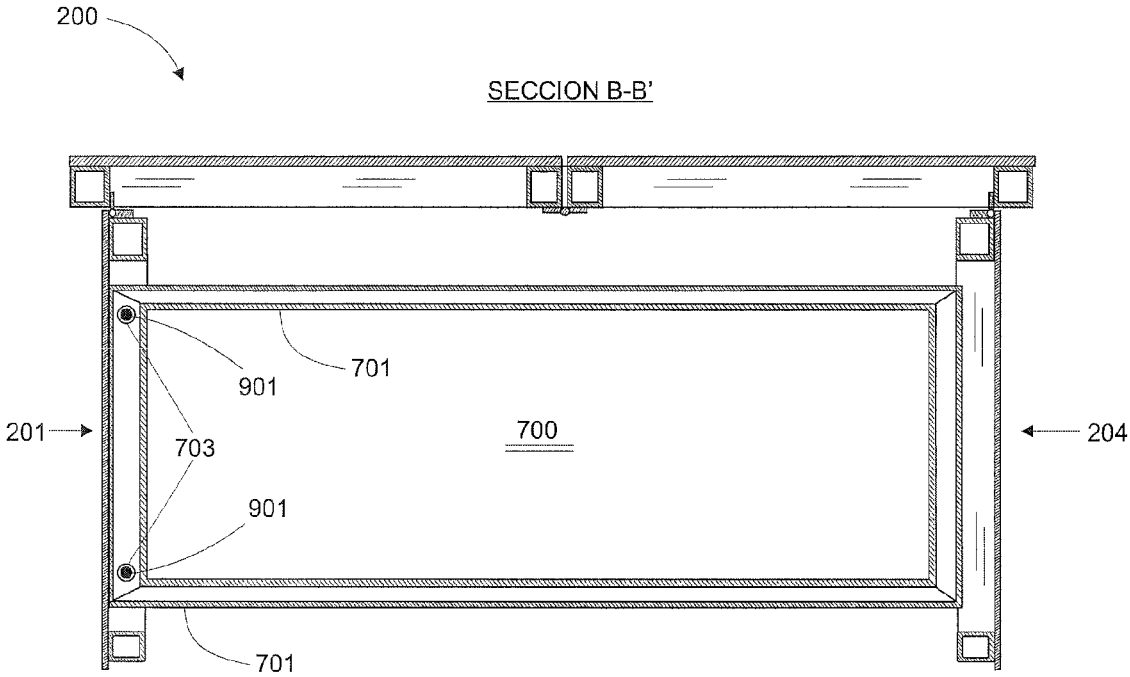
FIG. 11 is a longitudinal section view taken alongside line B-B' of the base shown in FIG. 4.
Figure 13:
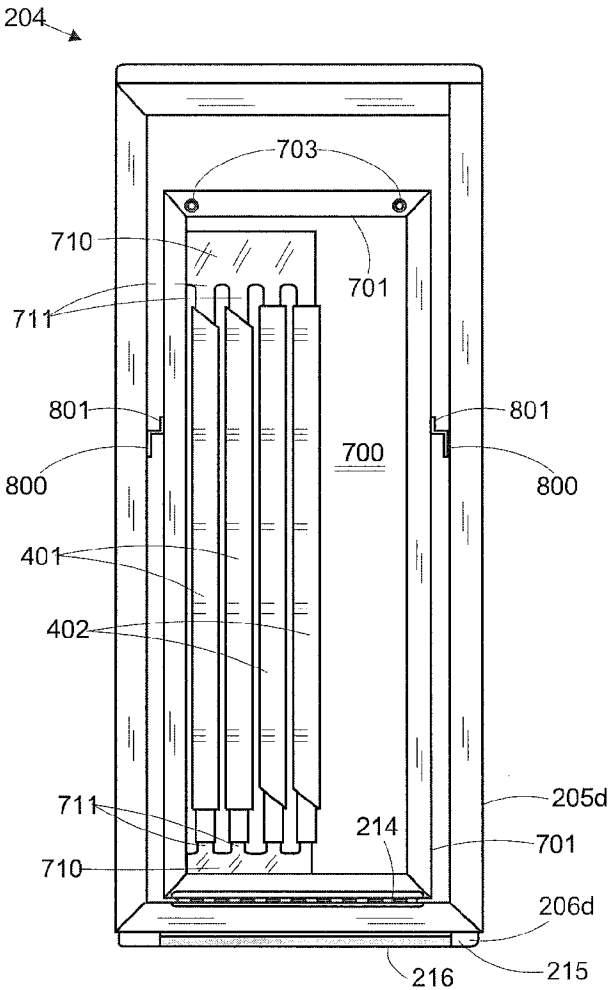
FIG. 13 is a rear view of the second side panel with the second shelf housed therein and the posts housed in the second shelf, said elements belonging to the demountable display module of FIG. 1.

By reference to FIG. 13, which shows a rear view of the second side panel 204, it can be mentioned with respect to the second shelf 700, that the latter is hingedly attached to said second side panel 204, for that purpose a fourth hinge 214 is used that is fixed over a lateral end of the frame 205*d* of the second side panel 204 and over one end of the second shelf frame 701, such that the second shelf 700 can rotate downwardly over said fourth hinge 214 to be placed horizontally between the side panels 201 and 204 of the base 200 when it is in its "stand up" position, just like the second shelf 700 represented in FIG. 11. Turning again to FIG. 13, the second shelf 700 also rotates on the fourth hinge 214 in order to be housed in a vertical position inside the second side panel 204.

On the other hand, one of the main features of the present invention is the provision of firs means for supporting the first shelf in a horizontal position when the base is in the "stand up" position, said first means also being useful for securing the second shelf in a vertical position when housed inside the second side panel.

In the preferred embodiment described, said first supporting means are a first pair of brackets 800 that are attached over the internal surface of the lateral sides of the frame 205*d* from the second side panel 204 and faced to each other. In addition, the brackets 800 include a cylindrically-shaped stem 801 that vertically extends upwardly (see FIG. 13).

Figure 10:
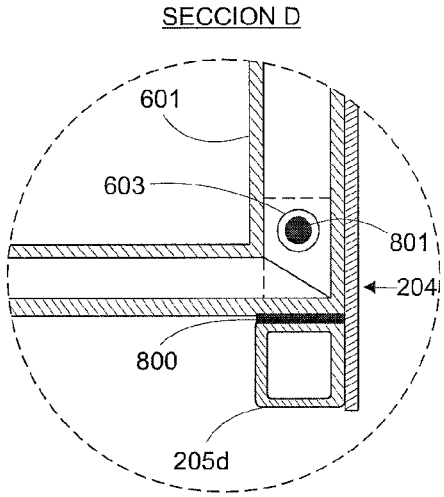
FIG. 10 is an expanded view around the area of circle "D" of FIG. 8.

The manner in which the brackets 800 support the first shelf 600 in a horizontal position can be seen in FIGS. 8 and 10, wherein it is noteworthy that each bracket 800 has an adequate surface so that the corners of the first shelf frame 601 abut against the brackets 800; furthermore, the first shelf frame 601 includes a first pair of holes at the lower surface of its free side end adjacent the second side panel 204 in order to receive the stem 801 from each bracket 800. Particularly in FIG. 10, part of one of the brackets 800 that supports the first shelf frame 601 is represented by a dashed line; in this same figure a lateral side of the frame 205*d* from the second side panel 204 can be seen.

Another function of the first pair of brackets 800 is to secure the second shelf 700 in a vertical position when housed inside the second side panel 204, which can be seen more clearly in FIG. 13.

Similarly, the demountable display module of the present invention comprises second means for supporting the second shelf in a horizontal position when the base is in the "stand up" position, the second means additionally being useful for securing the first shelf in a vertical position when housed inside the first side panel.

Figure 12:
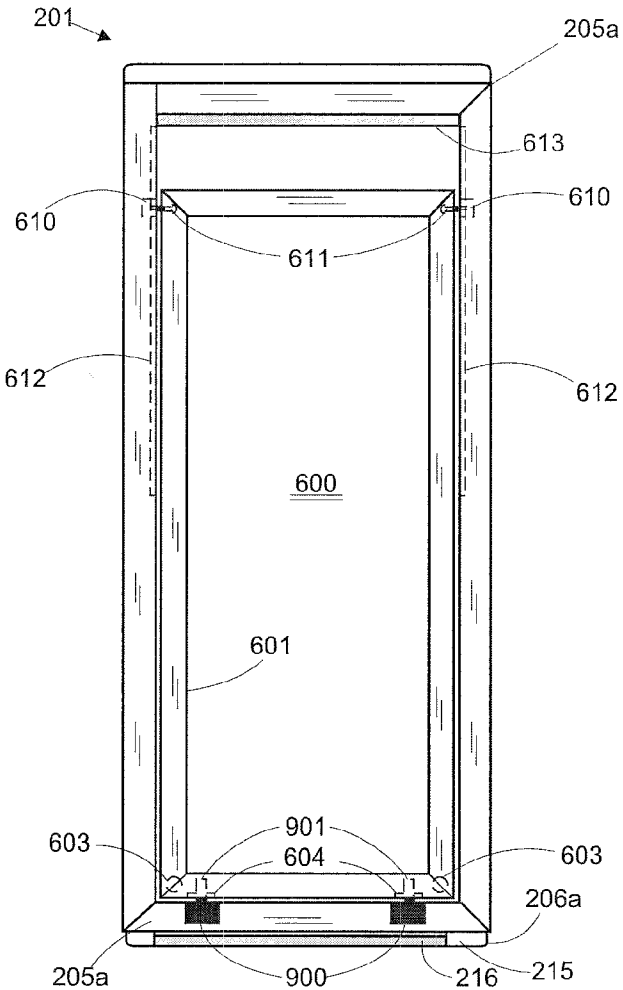
FIG. 12 is a rear view of the first side panel of the base with the first shelf housed therein.

In the preferred embodiment that is described, the second supporting means are a second pair of brackets 900 that are attached to the internal surface of the lower side of the frame 205*a* of the first side panel 201, as can be seen in FIG. 12; the brackets 900 of the second pair include a cylindrically-shaped stem 901 that extends vertically upwardly.

The manner in which the brackets 900 horizontally support the second shelf 700 can be seen in FIG. 11, wherein the second shelf frame 701 can be seen as including a second pair of holes 703 at the internal surface of its free side end to receive stem 901 of each bracket of the second pair. The holes 703 can also be seen in FIG. 13.

Another function of the brackets 900 of the second pair is to secure the first shelf 600 in a vertical position when housed inside the frame 205*a* of the first side panel 201, as represented in FIG. 12. For such purpose, the first shelf frame 601 includes a third pair of holes 703 over the external surface of its free side end so as to receive the stem 901 of each bracket 900 of the second pair. The third pair of holes 604 can also be seen in FIG. 8.

It shall become evident to those skilled in the art that the first and the second supporting means can be provided in the form of plates coated with Velcro® or with plates including male-female couplings.

On the other hand, at the lower part of FIGS. 12 and 13, it is also observed that the sheet 206*a* and the sheet 206*d* of the first and second side panel 201 and 204 extend respectively underneath their frame 205*a* and 205*d* to contact the floor, thereby forming a lower lug 215, in which each side panel 201 and 204 includes a reinforcement plate 216 attached to its sheet and to the external surface of the lower side of its frame, so as to withstand the vertical stresses applied over the module when totally mounted.

Another important feature of the preferred embodiment of the present invention that can be seen in FIG. 13 is that the second shelf 700 includes a pair of fasteners 710 in the shape of a comb that are attached on the internal surface of the second shelf frame 701 and sufficiently separated to each other such that the lower section 401 and the upper section 402 of the posts are fastened by their ends between the teeth 711 of one fastener and the other one. The fasteners are made of PVC or aluminum, preferably aluminum.

Once having described the most significant features of the base 200, it is convenient to refer to FIGS. 14 through 17, wherein various views of the cover 300 can be appreciated, the cover has the shape of a rectangular housing with an upper face 301, side faces 302 and 303, a front face 304, a lid 305 with a handle 306 and the cavities 307; additionally, the cover 300 includes lower tabs 308 extending from the side faces 302 and 303, the front face 304 and the lid 305 towards the interior of said cover 300 running in parallel with respect to the upper face 301. The free end of all the lower tabs 308 form a coupling edge 309 with the same contour that the upper part of the base 200 in its "stand up" position, such that the cover 300 perfectly couples over the base 200. In addition, the lower tabs 308 include 45° cuttings 310 by their lateral sides to make a side contact to each other. These cuttings 310 allow the cover 300 to withstand impacts and loads in case of accidents or during the handling and haulage of the display module with all of the pieces inside the cover 300, thereby overcoming the resistance shortfalls of the prior art.

As mentioned above, at the cover 300, the lid 305 hingedly attaches to the upper face 301. In the embodiment described, this attachment takes place by means of a fifth hinge 315 that fixes inwardly and sideways of the adjacent edges between the upper face 301 and the lid 305. It is important to mention that the upper face 301 includes a recess 311 inside which one of the plates of the fifth hinge 315 is housed (see FIG. 15). The latter has the advantage that it prevents scratches to the surface of the base panel sheets from occurring each time the base is taken out and put into since the hinge stays at a lower level than the internal surface of the upper face 301.

By specifically referring to FIG. 17, it is observed that the handle 306 included in the lid 305 is formed by means of a cloth strip 312 whose ends are bound by the interior of the lid 305 (see FIG. 14). The handle 306 includes a plastic reinforcement 313 that surrounds the section of the cloth strip 312 located externally of the lid 305, as shown in FIG. 17.

The cover 300 also includes means for opening and closing the lid 305 that, in the embodiment shown, comprise the following: a pair of mobile pins 320, each one of them is internally located and close to one lateral side of the lid 305, each pin 320 coming in and out through a hole 314 included at each side face 302 and 303 of the cover 300; a pair of levers 321 operably connected to a pin 320 and driven by the outside of the lid 305 in order to move the pin 320 inwardly and outwardly of the hole 314; and a pair of housings 322 embedded over the lid 305, each housing receiving one lever 321 and including opening and closing position indicators of the lid 305, as specifically shown in FIG. 17.

With the purpose that the cover 300 is further resistant to blows and falls when the parts of the module are stored therein, a pair of reinforcements are provided that, in the embodiment shown, are a pair of bent aluminum sheets 330 at an angle of 90° that are fixed at the internal corners between the front face 304 and the side faces 302 and 303 of the cover 300; in particular, the aluminum sheets are represented by a dashed line in FIG. 15, since they are hidden.

With the purpose of solving the issue of the base movement inside the cover, the display module additionally comprises an impact-absorption pad 340 that is attached and housed inside of the front face 304 of the cover 300; and a pair of impact absorption cushions 350 fixed inside of the lid 305 of the cover 300; the pad 340 and said cushions 350, which can be seen in particular in FIG. 15, impede the horizontal and vertical movement of the base in its "collapsed" position when housed inside the cover 300, the pads 340 and the cushions being manufactured in expanded polystyrene or polyurethane.

Figure 18:
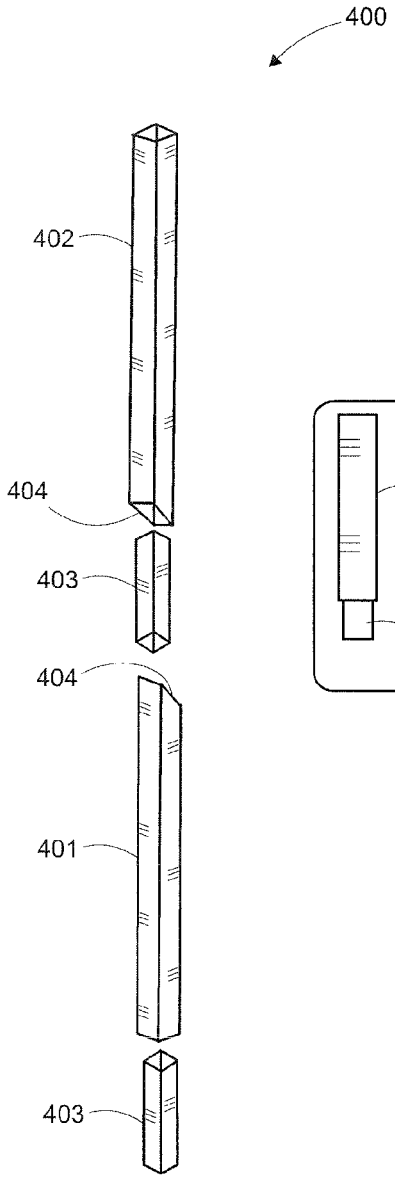
FIG. 18 is a perspective and exploded view of one of the posts that belongs to the demountable display module of FIG. 1.

Referring now to FIG. 18, an exploded view of one of the posts 400 is shown therein. Each post is formed by a lower section 401 and a upper section 402, and each of these sections 401 and 402 include a coupling portion 403 of tubular profile at their lower end, said portion being of a smaller diameter and thereby forming a lug, wherein in order to assemble each post the coupling portion 403 of the upper section 402 is totally housed inside the upper end of the lower section 401 until the upper section 402 contacts with the lower section 401. Preferably, the upper end of the lower section 401 and the lower end of the upper section 402 each include a 45° second diagonal cutting 404 for providing stability to each of the posts assembled.

Figure 19:
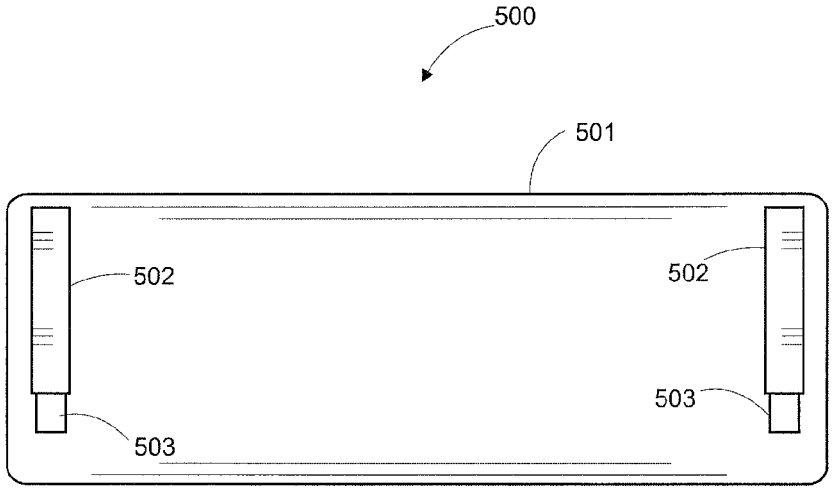
FIG. 19 is a rear view of the board that belongs to the demountable display module of FIG. 1.

Reference is now made to FIG. 19, in order to describe the structure of the board 500, which is formed by a sheet 501 and a pair of coupling bases 502, each of the coupling bases 502 including at its lower end a coupling segment 503 of tubular profile housed and attached inside of the lower end, thereby forming a lug, and the board is coupled to the upper end of each post.

Figure 20:
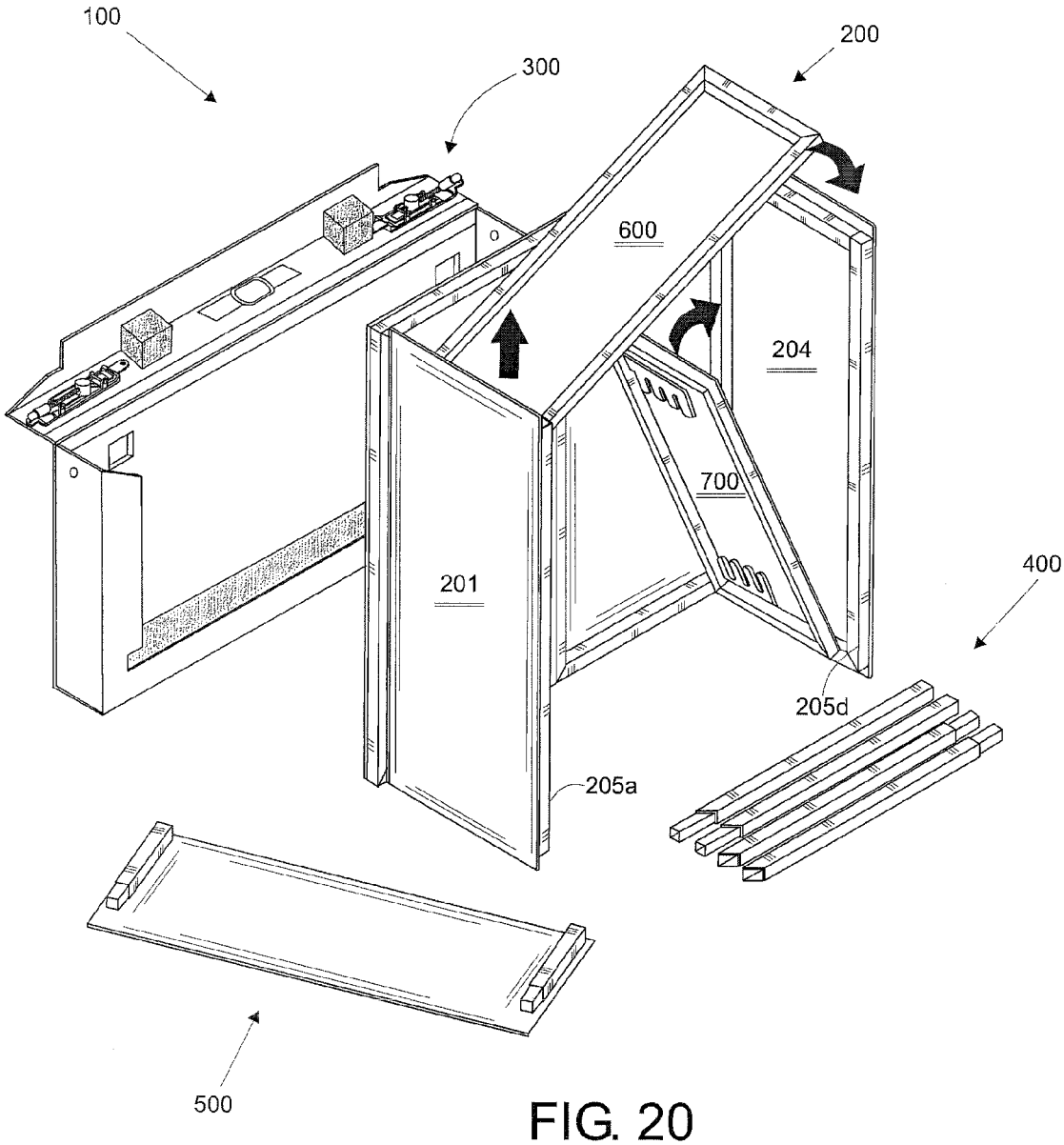
FIG. 20 is an upper perspective view of the demountable display module of FIG. 1, showing its detached pieces and the shelves being moved to be housed in the base side panels.

Furthermore, it is convenient to refer to FIG. 20, so as to describe the manner in which the display module 100 is demounted and stored in the form of a briefcase. In said figure, the board 500 is shown demounted from each of the posts 400, which in turn are detached from said cover 300 and the latter from the base 200, wherein both the first shelf 600 and the second shelf 700 move from their horizontal position to be housed, respectively, inside the frame 205*a* and 205*d* of the first or second side panel 201 or 204 to which they are attached to, as represented with the movement arrows shown in FIG. 20.

Upon completion of such movement, the shelves reach a vertical position as shown in FIGS. 12 and 13. From FIG. 13, it is important to point out that the lower section 401 and the upper section 402 of each post 400 is housed within the teeth 711 of the fasteners 710 included inside the second shelf frame 701.

Figure 21:
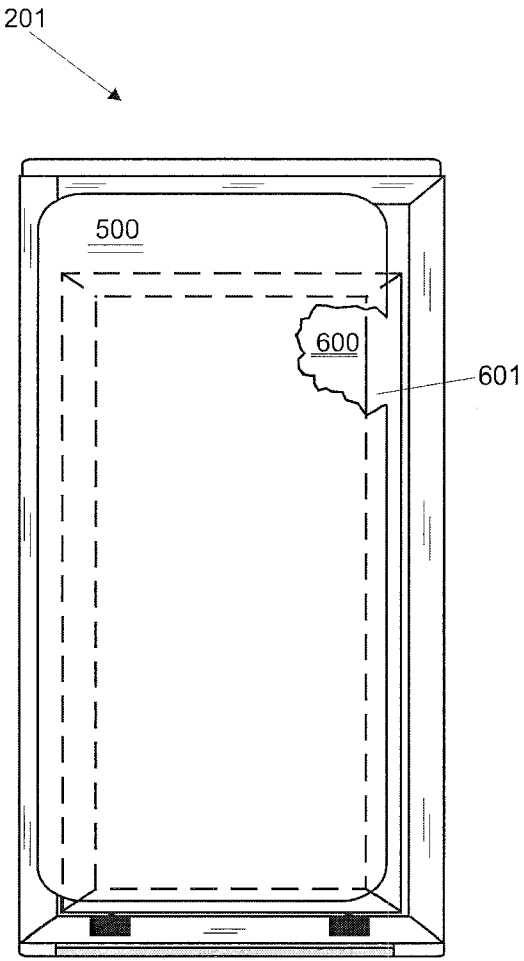
FIG. 21 is a rear view of the first side panel with the first shelf and the board housed therein.

Once the first shelf 600 and the second shelf have been housed, the board 500 is placed over the first shelf 600 that is already housed inside the frame 205*a* from the first side panel 201 as shown in FIG. 21, wherein the first shelf frame 601 is shown with a dashed line since it is hidden by the board 500.

Figure 22:
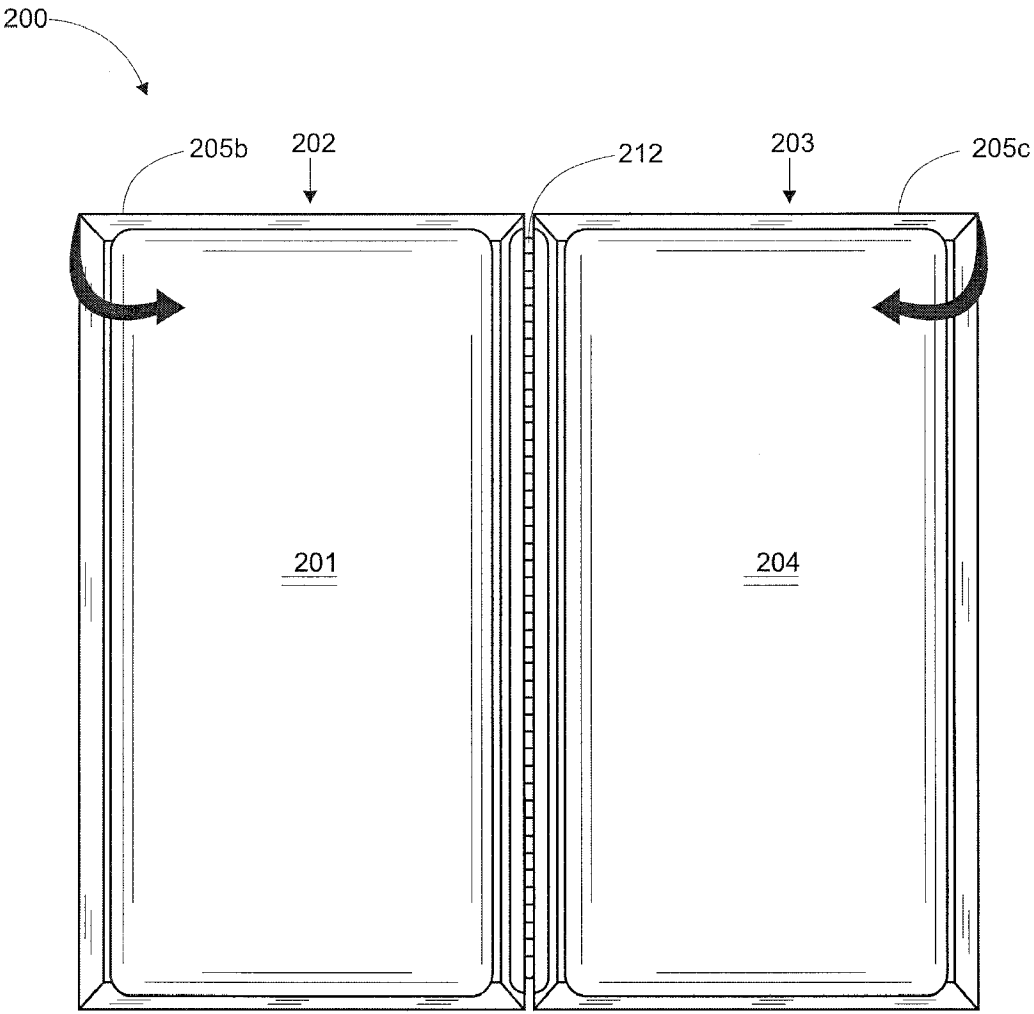
FIG. 22 is a rear view of the base with its side panels housed in its front panels.
Figure 23:
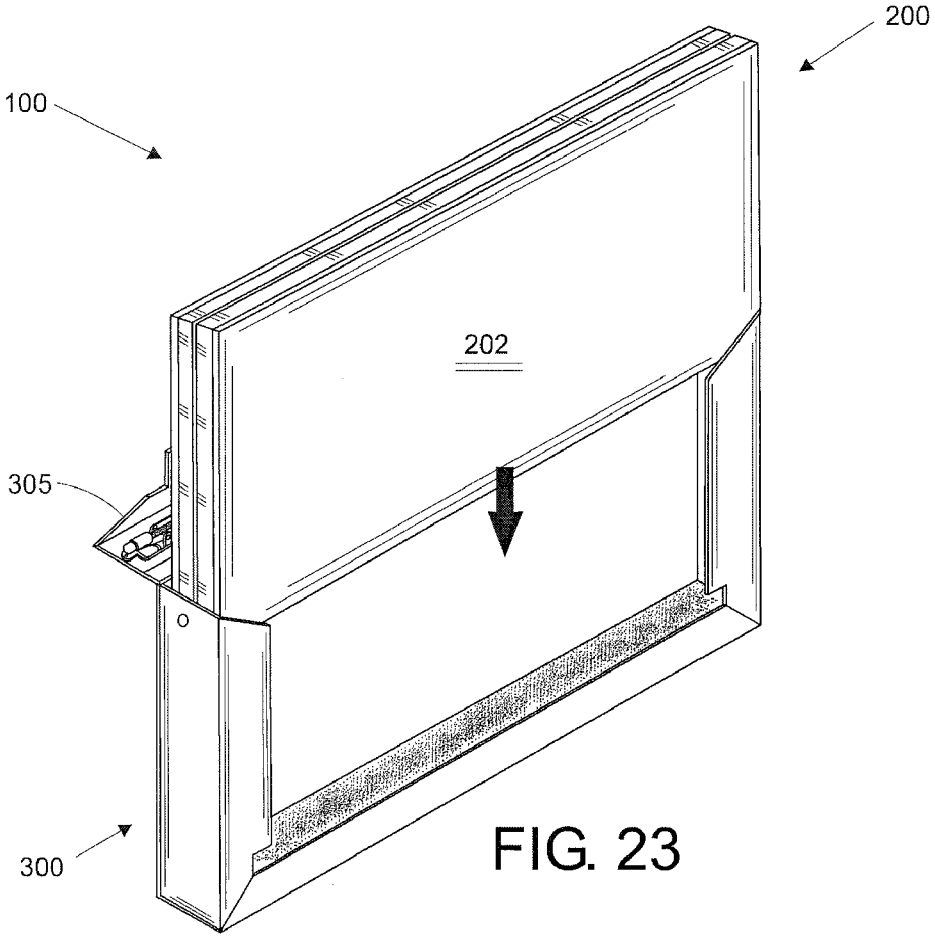
FIG. 23 is a perspective view of the base in its "collapsed" position and being stored within the cover.

Subsequently, the side panels 201 and 204, having the posts and the board housed in their respective shelf, move inwards the base 200 in order to housed in the inner part of the frame 205*b* and 205*c* of the first and second front panel 202 and 203 to which the side panels are attached, as in FIG. 22, which is a rear view of the base 200. After the front panels 202 and 203 has the side panels 201 and 204 housed, they rotate inwards the base over the second hinge 212 to be face to face to bring to the "collapsed" position of said base 200, which is inserted through the lid 305 of said cover 300 that works as a container body as shown in FIG. 23, where the first front panel 202 can be seen in the collapsed base 200.

Figure 24:
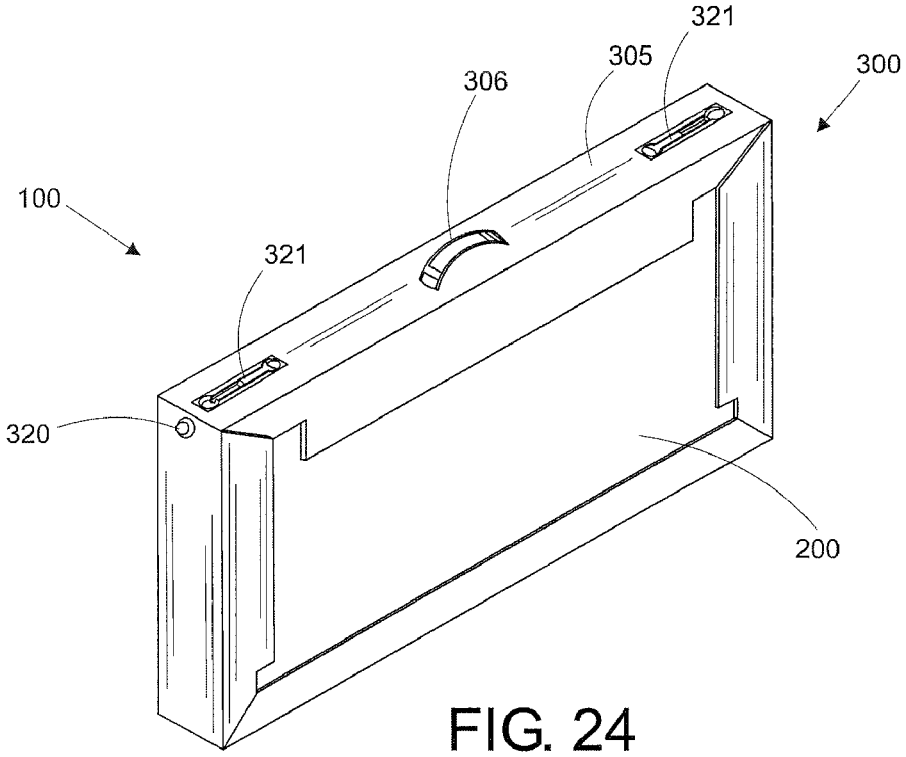
FIG. 24 is a view of the demountable display module of FIG. 1, the module being stored in the form of a briefcase.

Once the base 200 is inside the cover 300, the lid 305 is closed by pins 320 which are driven by the levers 321 keeping in this way the display module 100 in the form of a briefcase that can be taken by a user from the handle 306 y carry it anywhere, as shown in FIG. 24. In the briefcase, the base does not move due to the pad 340 and the cushions 350 described in FIG. 14.

In order to protect the cover 300 from scratches when the display module is carried around as briefcase, a cloth or canvas cover within which the entire briefcase is inserted may be used. The cover includes an opening to take the handle of the briefcase.

Regarding the manufacturing materials with which the demountable display module 100 of this invention is manufactured, it is preferred to use PVC either for the frame or sheets of the panels of the base, as well as for the panels, the shelves, and the board. It is also preferred to use aluminum for the used hinges.

In an alternate embodiment, plastic or metallic eyelets are provided to coat the walls of the first, second, and third pair of holes 603, 604, and 703 which are provided in the first shelf and in the second shelf 600 and 700. This same feature also can be included in each hole 714, of the cover. The eyelets have the function of preventing damages and cracks in the nearby zones to the aforementioned holes and piercings.

Figure 25:
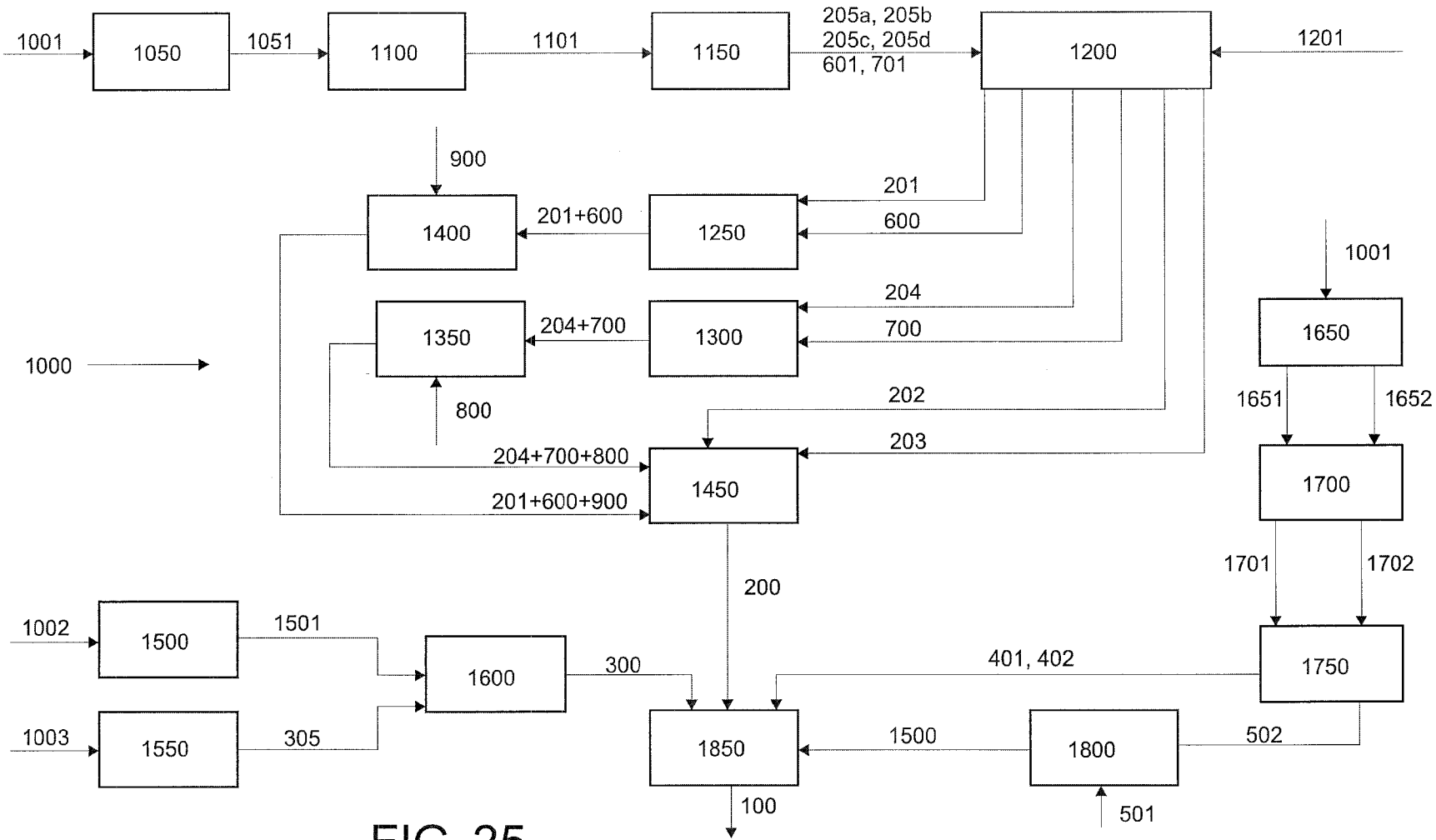
FIG. 25 is a block diagram of the process to manufacture the demountable display module that is stored in the shape of a briefcase of the present invention.

On the other hand, reference is made to FIG. 25 where it is shown a flow chart of a preferred embodiment of the procedure 1000 to elaborate the display module 100 of this invention. It is worth mentioning that in FIG. 25, the major part of the numerical references that have been used for the most important described elements in FIGS. 1 to 24 are still being kept.

Procedure 1000 starts with a first extrusion step 1050, where from the PVC particles 1001, a first tubular profile 1051 is extruded, preferably a cross-section square profile that, in the first cutting step 1100, is cut in a first six-section-group 1101, each of them with a predetermined length. The sections are used in a construction step 1150, where six frames 205*a*, 205*b*, 205*c*, 205*d*, 601, and 701 are obtained, from which, frames 205*a* and 205*d* are the frames for each of the side panels of the base; frames 205*b* and 205*c* are the frames for each of the two front panels of the base, frame 601 is the shelf frame, and frame 701 is the second shelf frame.

In an alternate embodiment of the procedure, in the first cutting step 1100, a first group of three triangular separated cuts are made over two sections that, in the first construction step 1150, they are used in order to get the frame 205*a* or 205*d* of each side panel 201 or 204. In said construction step 1150, each of these sections is bended over each triangular cut and their ends are perpendicularly attached to form frames 205*a* and 205*d* of the side panels.

In said alternate embodiment, in the first cutting step 1100, a further pair of slots is made over the lateral sides of the section that is used to manufacture frame 205*a* of the first side panel; the slots have an important function which will be noted when the first mounting step 1250 is described.

En the same alternate embodiment, in the first cuffing step 1100, a further second group of three triangular cuts is made over the four remaining sections that, in the construction step 1150, are used in order to get frames 205*b* and 205*c* of the front panels. The first shelf frame 601 and the second shelf frame 701 and besides, over each end of these four sections, a 45° diagonal cut is made with which, in the construction step 1150, each of said four sections is bended over each triangular cut and their ends are attached in order to form frames 205*b* and 205*c* of the frontal panels, the first shelf frame 601 and the second shelf frame 701.

After the construction step 1150, a first pasting step 1200 takes place, where a six-sheet-group 1201 is provided, each of them has an suitable size to cover one of the frames formed in the construction step 1150, resulting from this step 1200 a first side panel 201, a second side panel 204, a first front panel 202, a second front panel 204, a first shelf 600, and a second shelf 700.

In a further embodiment of the procedure, in the first pasting step 1200, each set of frame and sheet of the panels of the base and the shelves is allocated in a press that keeps it fixed applying glue over the corners of each frame and over the attaching surfaces between the respective frame and the sheet.

Regarding again FIG. 25, there is a first assembly step 1250 where the first shelf 600 is attached to one of the side ends between the lateral sides of the frame of the first side panel 201 in a way that the first shelf 600 remains attached in a slidable way.

Preferably, the first shelf 600 is attached to the first side panel 201 by a pair of sliding bases, each of them is housed in one of the lateral sides of the frame of the first side panel 201, and a pair of shafts, each of them is attached by an end over the outer surface of the corners of one of the side ends of the first shelf frame 701 and by their other end, each end is attached to one of said sliding bases; the shafts passing through said slots. The sliding bases, the shafts, and the slots were represented in FIG. 9 and have their respective references 610, 611, and 612.

In the procedure 1000, a second mounting step 1300 is made, where the second shelf 700 is attached by one of its side ends to the lower side of the frame of the second side panel 204, in a way that the second shelf 700 is hingedly attached; in order to achieve this, an aforementioned hinge as fourth hinge 214 (FIG. 13) is used, and it is preferably fixed by rivets.

Once the second shelf 700 is attached to the second side panel 204, a first fixing step 1350 is carried out, where the first support and securing means are fixed over an inner surface of each of the lateral sides of the frame of the second side panel 204. In a preferred way, the first support and securing means is a first pair of brackets 800 that have a stem that is vertically upwards designed.

Similarly, a second fixing step 1400 is made, where the second support and securing means are fixed over the inner surface of the lower side of the frame of the first side panel 201; these second support and securing means are a second pair of brackets 900 that also have a stem that is vertically upwards designed.

Then, a first assembly step 1450 is carried out, where the first side panel 201 is attached to the first front panel 202; the first front panel 202 is attached to the second front panel 203, and the second front panel 203 is attached to the second side panel 204 in a way that the panels remain attached one next to the other in a hinged way getting the base 200 of the module.

In the first assembly step 1450, the side panels 201 and 204, as well as the front panels 202 and 203 are clamped by a support that keeps them attached to all these panels, and then, the adjacent sides are pierced between the frames of the panels and a first hinge is fixed between the first side panel 201 and the first front panel 202; a second hinge between both front panels 202 and 203; and a third hinge between the second front panel 203 and the second side panel 204. In a preferred embodiment, in the assembly step 1450, the first, second, and third hinges are fixed by rivets.

Now, in order to form the module cover, a first thermal bending 1500, where a first plate 1002 is heated to get in one single piece the main body 1501 of the cover, said main body includes the upper face, the side faces, the front face, and the tabs that extend from the side faces and the front face of the cover.

Also, in the procedure 1000, a second thermal bending step 1550 takes place, where a second plate 1003 is thermally bent in order to get one single piece of the lid 305 and the lower tab that extends therefrom.

Then, a second assembly step 1600 is made, where the lid 305 got in the second thermal bending step 1550 is assembled to the main body 1501 of the cover with which the cover 300 is completed with its lid.

In a preferred way, in the first thermal bending step 1500, the first plate 1002 is provided with channels in order to delimit the zones over which the front face, the side faces, and the lower tabs that extend therefrom are formed; subsequently, said channels are along heated and the first plate 1002 is bended over the same, forming in this way the main body 1501 of the cover. The channels are made over the first plate 1002 using machines and tools such as scrapers, punches, chisels or an electric graver ("router") of number control. With these machines and tools, a recess is made along the edge of the main body 1501 that will attach to the lid 305 in the second assembly step 1600.

The channels are preferably heated by electric resistances and the material used for the first plate is preferably foamed PVC or another polymer that could be bended by heating. In a further embodiment of the procedure, at the same time that the channels are heated, the temperature of the rest of the first plate is kept at room temperature, whereby the bending of the plate through channels is achieved; therefore, the obtained dimensions in the main body 1501 of the cover are those required to firmly assembly the cover 300 over the base 200 and to keep all the elements of the display module.

In a similar way, in the second thermal bending step 1550, the second plate 1003 is made up of foamed PVC and it is provided with a channel so as to define the zone where the tab that extends from the lid will be formed, and the holes to install the handle and the lid opening and closing means. Subsequently, the channel is heated and the second plate is bended along itself, getting in this way the lid 305 which is attached to the main body 1501 by a fifth hinge, from which one of its plates is housed along the recess formed in the main body 1501 of the cover.

On the other hand, in the procedure 1000, the sections of the module posts and boards may be formed, in order to get that, other PVC films 1001 are fed in a second extrusion step 1650, and a second tubular profile 1651 and a third tubular profile 1652 are extruded, both preferably being cross-section squared profile, where the third tubular profile 1652 has a lower diameter than the second tubular profile 1651.

Both the second and the third tubular profiles 1651 and 1652 are cut in a second cutting step 1700 getting from the second tubular profile 1651 a second six-section group 1701 each of them with a predetermined length; and from the third tubular profile 1652 a third six-section group 1702 is obtained, each with a predetermined length.

In the preferred embodiment, four of the sections of the second group 1701 are provided with a second diagonal cut at 45° in one of their ends, these four sections will make up the lower and upper section of each one of the posts.

Later, en an attachment step 1750, each of the six sections of the third group 1702 is attached within an end of one of the six sections of the second group 1701, so that each section of the third group 1702 is projected from the end where it is inserted, getting at the end of the step the lower section 401 and the superior one 402 from each of the posts and each of the two coupling bases 502 of the board. In this attachment step 1750, glue is preferably used for PVC to carry out the required attachment.

Then, in a second pasting step 1800, the coupling bases 502, from the previous step are attached to a sheet 501, getting in this way the board 500 of the module. In a preferred way, in the second pasting step 1800, a press that keeps a sheet 501 fixed and the coupling bases 502 are used and glue is applied over the attaching zones of these elements.

Finally, in FIG. 25, the existence of a packing step 1850 can be seen, where the base 200, the sections of the posts 401 and 402 and the board 500, which are respectively obtained in steps 1450, 1750, and 1800 are kept in the cover 300 obtained in step 1600, getting at the end of step 1850 the demountable display module 100 in the form of a briefcase, which after the packing step 1850 is distributed to the points of sale.

As it is observed, in the steps of the procedure 1000, the materials used to manufacture the display module of this invention are maximized. In a preferred way, only tubular profiles and PVC sheets are used, as well as the aluminum hinges. For the skilled in the art persons it will be evident that the module may be manufactured with other materials keeping the structural relationship among the elements of the module.

According to the above described, it could be seen that the demountable display module of this invention has been thought to have an excellent stability when it its completely assembled, particularly, the stability is improved in the shelves and the board, and it will be evident to any skilled in the art that the above described embodiment is only illustrative rather that limited of this invention since several consideration changes are possible without departing from the scope of the invention, such as size of the panels, shape of the frames of the panels and the posts, as well as the means that are used to support and securing the shelves when the module is mounted or stored as a briefcase.

Even when a preferred embodiment of the invention has been described and exemplified, it should be stressed that several modifications of it are possible. Therefore, this invention should not be considered as limited except for what it is required by the prior art and by the scope of the appended claims.

What is claimed is:

1. A demountable display module that is stored in the form of a briefcase, comprising;

a) a base comprising panels that are hingedly attached one next to the other so that said base has a "collapsed" position and an "stand up" position, wherein said panels define the base, and said panels comprise a first side panel, a first front panel perpendicular to the first side panel, a second front panel next to the first front panel and a second side panel perpendicular to the second front panel and opposed to the first side panel; each of said panels including a rectangular frame and a sheet that covers and that is attached to the frame and when while in the "collapsed" position of the base, each side panel is housed within the frame of the front panel to which it is attached and both front panels are facing each other;

b) a cover demountably coupled on said base when it is in the "stand up" position; said cover having the form of a rectangular housing with an upper face, two side faces, a front face, a lid with a handle attached to the upper face and that is the opposite of the front face, lower tabs that extend from the front face, the side faces and the lid inwards said cover in a parallel disposition to the upper face, a pair of cavities over the upper face and means for opening and closing the lid;

c) a pair of posts, each of the posts being coupled in a demountable way by its lower end to the frame of one of the side panels and passing through said cover by one of its cavities when the cover is assembled over said base; the posts being formed by a lower section and an upper section that couple each other;

d) a board demountably joined to the upper end of each of said posts;

e) a first shelf located between both side panels and being raised with respect to the lower edge of said base in its "stand up" position; said first shelf being slidably attached by one of its side ends to the first side panel and comprising a first rectangular shelf frame and a first shelf sheet that covers and it is attached to the first rectangular shelf frame; said first shelf being housed within the frame of the first side panel when the base is in the "collapsed" position;

f) a second shelf located between both side panels and being separated below said first shelf; said second shelf being hingedly attached by one of its side ends to the second side panel comprising a second rectangular shelf frame and a second shelf sheet that covers and is attached to the second shelf frame; said second shelf being housed within the frame of the second side panel when said base is in the collapsed position;

g) first means for supporting the first shelf in a horizontal position when the base is in the "stand up" position and to secure the second shelf in a vertical position when it is housed within the frame of the second side panel;

h) second means for supporting the second shelf in a horizontal position when the base is in the "stand up" position and to secure the first shelf in vertical position when it its housed within the frame of the first side panel;

wherein to demount and store the elements of the display module in the form of a briefcase, the board is demounted from each of the posts, that, in turn are demounted from said cover and the latter from said base, where the first shelf and the second shelf are housed within the frame of the side panel to which they are attached, and wherein the lower and upper section of each post are uncoupled to be within the second shelf frame; therefore, the board is placed over the housed first shelf housed, and the side panels with their shelf are housed within the frame of the front panel to which they are attached, and then, the front panels face each other resulting in the "collapsed" position of said base, which is inserted through the lid of said cover, said cover comprises a container body to keep and transport all the elements of the display module in the form of a briefcase.

2. The display modules according to claim 1, wherein said first shelf is on the base with its first shelf frame facing upwards, whereby the first shelf frame is a barrier to prevent articles that have been put on the first shelf from falling to the floor, and the second shelf on the first shelf with its second shelf frame facing downwards so that the lower section and the upper section of the posts are housed in the second shelf frame when the second shelf is housed in the second side panel.

3. The display module, according to claim 1, wherein the first shelf is slidably attached to the first side panel by sliding means, said sliding means comprises:

i) a pair of cross-section sliding bases with "U" form, each said sliding base being disposed within the lateral side of the frame of the first side panel;

ii) a pair of shafts, each said shaft being attached by one of their ends to one of said sliding bases and by the other end, each shaft attaches over the outer surface of the corners of one of the side ends of the first shelf frame; each sliding base with its shaft running downwards along a slot included at the inner face of each lateral side of the frame of the first side panel, whereby in the lowest part of each slot, said first shelf rotates about the shafts in order to be horizontally placed between the side panels of the base when it is in the "stand up" position, whereas in order to house said first shelf in the frame of the first side panel, the first shelf runs upwardly over each slot and then it rotates about the shafts to be housed in a vertical position within the frame of the first side panel; and;

iii) an abutment attached to the inner surface of the upper side of the frame of the first side panel to limit the upward movement of the first shelf.

4. The display modules according to claim 1, wherein the frame of the first side panel and the frame of the second side panel include an aperture facing upwards in order to house the lower end of each of said posts.

5. The display module according to claim 4, wherein the frame of the first side panel and the frame of the second side panel comprise said aperture in its upper and rear corner.

6. The display modules according to claim 1, wherein said first support and securing means comprise a first pair of brackets that are attached over the inner surface of the lateral sides of the frame of the second side panel, the brackets facing each other; the brackets being sized so that the corner of the first shelf frame abuts against the brackets, which also include a cylindrical stem extending vertically upwards; the first shelf frame including a first pair of holes in the lower surface of its side end free to receive the stem of each bracket of said first pair in order to support in a horizontal position said first shelf; whereas the second shelf is secured in a vertical position between the brackets when housed in the second side panel.

7. The display modules according to claim 1, wherein said second support and securing means comprise a second pair of brackets attached over the inner surface of the lower side of the frame of the first side panel; the brackets of the second pair including a cylindrical stem that extends vertically upwards and the second shelf frame including a second pair of holes in the lower surface of its free side end to receive the stem of each bracket of the second pair, whereby the second shelf is supported in horizontal position; whereas the first shelf frame includes a third pair of holes over the outer surface of its free side end to receive the stem of each bracket of the second pair when the first shelf is housed in a vertical position within the first side panel.

8. The display modules according to claim 1, wherein the sheet of the first side panel and the sheet of the second side panel are extending to the bottom of each respective frame to contact with the floor, forming in this way a lower lug, where each side panel includes a reinforcement plate attached to its sheet and to the outer surface of the lower side of its frame in order to support the vertical efforts applied over the module when it is totally mounted.

9. The display modules according to claim 1, wherein the second shelf includes a pair of fasteners in the form of a comb, each of them being attached in the inner surface of the second shelf frame and separated form each other in an enough length so that the lower section and the upper section of said posts are secured by their ends between the teeth of a fastener and other one.

10. The display module according to claim 1, wherein the free end of the lower tabs of said cover comprise a coupling edge that having the same contour as the upper edge of said base in the "stand up" so that said cover is coupled over said base.

11. The display module according to claim 1, wherein the lid that is attached to the upper face by a fifth hinge that is internally fixed and along to the adjacent edges between the upper face and the lid, wherein the upper face includes a recess whereby one of the plates of said fifth hinge is housed.

12. The display module according to claim 1, further comprising: a pair of reinforcements, said reinforcements being fixed in the lower corners between the front face and the side faces of the cover.

13. The display modules according to claim 1, wherein said reinforcements comprise a pair of aluminum sheets bent at 90°.

14. The display module according to claim 1, further comprising an impact absorption pad attached and housed in the inner part of the front face of said cover, and a pair of impact absorption cushions attached within the lid of the cover, whereby the pad and said cushions prevent the horizontal and vertical movement of the base, in its "collapsed" position when it is housed in the cover.

15. A method for manufacturing the display module of claim l, the method comprising the steps of:

a) extruding a first tubular profile;

b) cutting said first tubular profile in a first six-section group, each said section being a predetermined length;

c) building from the first six-section group: a frame for each of the two side panels of the base, a frame for each of the two front panels of the base, a first shelf frame, and a second shelf frame;

d) attaching a sheet to each of the frames formed in the previous step, forming in this manner a first side panel, a second side panel, a first front panel, a second front panel, a first shelf, and a second shelf;

e) mounting the first shelf by one of its side ends between the lateral sides of the frame of the first side panel, in a manner that the first shelf is attached in a sliding way;

f) mounting the second shelf by one of its side ends in the lower side of the frame of the second side panel, in a manner that the second shelf is attached in a hinged way;

g) fixing first support and securing means over the inner surface of each of the two lateral sides of the frame of the second side panel;

h) fixing the second support and securing means over the inner surface of the lower side of the frame of the first side panel;

i) assembling: the first side panel with the first front panel; the first front panel with the second front panel, and the second front panel with the second side panel, in a way that the panels are hingedly attached one next to the other, getting the base of the module;

j) thermo-bending a first plate to get in a single piece the main body of the cover, said main body including the upper face, the side faces, the front face, and the tabs that extend from the side faces and the front face of the cover;

k) thermo-bending a second plate to get in one single piece the lid and the lower tab that extends therefrom;

l) assembling the lid obtained in the previous step to the main body, getting the cover with its lid;

m) extruding a second tubular profile and a third tubular profile, where the third tubular profile has a smaller diameter than the second tubular profile;

n) cutting the second tubular profile as well as the third tubular profile in order to get from each one of the same a second six-section group, each of them with a predetermined length; and a third six-section group, each said second section having a predetermined length;

o) inserting and attaching each of the six sections of the third group of the third tubular profile within an end of one of the six sections obtained from the second tubular profile, in a way that each section of the third group is projected from the end where it is inserted, obtaining at the end of the step: the upper and lower section of each of the two posts and each of the two coupling bases of the board;

p) attaching the coupling bases obtained in the previous step in a sheet, thus obtaining the board; and, q) packing the base, the sections of the posts, and the board respectively obtained in steps (l), (o) and (p) in the cover obtained in the step (i), whereby at the end of this packing step the display module is obtained.

16. The method according to claim 15, wherein in the cutting step (b) of the first tubular profile, a first group of three triangular cuts separated from each other is further performed over two sections which, in the construction step (c), are used to obtain the frame of each side panel, in a manner that in said construction step (c), each of these sections is bent over each triangular cut and their ends are perpendicularly attached to form the respective frame of each side panel.

17. The method according to claim 15, wherein in the cutting step (b) of the first tubular profile, a second group of three triangular cuts over each of the four sections is further performed which, in the construction step (c), are used to obtain the frame of each front panel, the first shelf frame and the second shelf frame, and at each end of said four sections, a 45° diagonal cut is formed, whereby each of said sections is bent over each triangular cut and their ends are attached to form: the frame of each front panel, the first shelf frame and the second shelf frame.

18. The method according to claim 15, wherein in the cutting step (b), a pair of slots over the lateral sides of the section are used to manufacture the frame of the first side panel are formed, whereby in the first assembling step (e), the first shelf is attached to said first side panel by: a pair of sliding bases, each of them is housed in one of the lateral sides of the frame of the first side panel; and a pair of shafts, each of them attached over the outer surface of the corners of one of the side ends of the first shelf frame and by its other end, each shaft being attached to one of said sliding bases; the shafts passing through said slots.

19. The method according to claim 15, wherein in the first attaching step (d), each frame and sheet set of the panels of the base and shelves is fixedly located in a press applying adhesive over the corners of each frame and over the attaching surfaces between the frame and the corresponding sheet.

20. The method according to claim 15, wherein in the first thermo-bending step (j), the first plate is provided with channels to delimit the zones over which the front face, the side faces, and the lower tabs are formed; likewise, a recess is formed along the edge the attaches to the lid; subsequently, heat is applied along said channels and the first plate is bent over the channels forming in this way the main body of the cover.

21. The method according to claim 20, wherein the channels are made up over the first plate using scrapers, punches, chisels, or an electric graver of control number.

22. The method according to claim 20, wherein the channels are heated by electric resistances.

23. The method according to claim 20, wherein at the same time that the channels are heated, the temperature of the rest of the first plate is kept at room temperature.

* * * * *